US011710923B2

(12) United States Patent
Hu et al.

(10) Patent No.: US 11,710,923 B2
(45) Date of Patent: Jul. 25, 2023

(54) COMPACT, RELIABLE CARD EDGE CONNECTOR

(71) Applicant: Amphenol Commercial Products (Chengdu) Co., Ltd., Chengdu (CN)

(72) Inventors: Xiaodong Hu, Chengdu (CN); Bryan Guo, Chengdu (CN); Kui Yang, Chengdu (CN)

(73) Assignee: Amphenol Commercial Products (Chengdu) Co., Ltd., Chengdu (CN)

( * ) Notice: Subject to any disclaimer, the term of this patent is extended or adjusted under 35 U.S.C. 154(b) by 48 days.

(21) Appl. No.: 17/386,252

(22) Filed: Jul. 27, 2021

(65) Prior Publication Data

US 2022/0037828 A1 Feb. 3, 2022

(30) Foreign Application Priority Data

Jul. 31, 2020 (CN) ..... 202010756166.1
Jul. 31, 2020 (CN) ..... 202021557848.1
(Continued)

(51) Int. Cl.
*H01R 13/502* (2006.01)
*H01R 13/627* (2006.01)
*H01R 12/73* (2011.01)

(52) U.S. Cl.
CPC ..... *H01R 13/502* (2013.01); *H01R 12/737* (2013.01); *H01R 13/6273* (2013.01)

(58) Field of Classification Search
CPC ..... H01R 13/502; H01R 12/737; H01R 13/6273; H01R 12/721
(Continued)

(56) References Cited

U.S. PATENT DOCUMENTS 3,573,706 A 4/1971 Haberlen
3,970,353 A 7/1976 Kaufman
(Continued)

FOREIGN PATENT DOCUMENTS

CN 1175101 A 3/1998
CN 202633554 U 12/2012
(Continued)

OTHER PUBLICATIONS

†U.S. Appl. No. 17/199,204, filed Mar. 11, 2021, Guo et al.
(Continued)

*Primary Examiner* — Abdullah A Riyami
*Assistant Examiner* — Nader J Alhawamdeh
(74) *Attorney, Agent, or Firm* — Wolf, Greenfield & Sacks, P.C.

(57) ABSTRACT

The present disclosure provides an electrical connector. The electrical connector includes an insulating body and one or more reinforcing members. The insulating body comprises a pair of side portions which extend in a longitudinal direction, and a pair of tower portions which are connected to respective ends of the pair of side portions. The pair of side portions and the pair of tower portions form a longitudinal card slot. The ends of the card slot extend into the pair of tower portions respectively. A reinforcing member may be arranged in a tower portion. When an electronic card is inserted into the card slot, the one or more reinforcing members can maintain the shape of the tower portions and prevent deformation or cracking of the tower portions when the electronic card is impacted by an external force.

20 Claims, 13 Drawing Sheets

(30) Foreign Application Priority Data

Dec. 11, 2020 (CN) ..... 202011458813.7
Dec. 11, 2020 (CN) ..... 202022974284.8

(58) Field of Classification Search
USPC ..... 439/328
See application file for complete search history.

(56) References Cited

U.S. PATENT DOCUMENTS

| | | | | |
|---|---|---|---|---|
| 4,487,468 | A | 12/1984 | Fedder et al. | |
| 5,393,247 | A | 2/1995 | DiOrazio et al. | |
| 6,638,105 | B1 | 10/2003 | Wu | |
| 6,648,682 | B1 | 11/2003 | Wu | |
| 7,008,250 | B2 | 3/2006 | Shuey et al. | |
| 7,074,067 | B2 | 7/2006 | Yang et al. | |
| 7,637,783 | B2 | 12/2009 | Sasaoka et al. | |
| 7,677,907 | B2 | 3/2010 | Guan et al. | |
| 7,892,006 | B2 | 2/2011 | Guan et al. | |
| 7,972,171 | B2 | 7/2011 | Teh | |
| 8,187,031 | B2 | 5/2012 | Li et al. | |
| 8,403,689 | B2 * | 3/2013 | Li | H01R 12/721 439/160 |
| 8,535,077 | B2 | 9/2013 | Shen et al. | |
| 9,325,090 | B2 * | 4/2016 | Shen | H01R 12/721 |
| 9,685,723 | B2 * | 6/2017 | Kee Mew | H01R 12/7005 |
| 10,103,476 | B1 * | 10/2018 | Qiu | H01R 13/10 |
| 10,135,165 | B2 | 11/2018 | Zuo | |
| 10,224,653 | B2 | 3/2019 | Niu et al. | |
| 11,374,340 | B2 * | 6/2022 | Tang | H01R 12/737 |
| 2010/0075538 | A1 | 3/2010 | Ohshida | |
| 2011/0065297 | A1 | 3/2011 | Guan et al. | |
| 2011/0067237 | A1 | 3/2011 | Cohen et al. | |
| 2011/0275238 | A1 | 11/2011 | Iijima et al. | |
| 2012/0178274 | A1 | 7/2012 | Manickam | |
| 2013/0280926 | A1 | 10/2013 | Ono | |
| 2016/0020540 | A1 * | 1/2016 | Shen | G06F 1/203 439/155 |
| 2016/0336667 | A1 * | 11/2016 | Kee Mew | H01R 12/7005 |
| 2019/0199023 | A1 * | 6/2019 | Soh | H01R 12/7064 |
| 2020/0203867 | A1 | 6/2020 | Lu | |
| 2021/0288423 | A1 | 9/2021 | Guo et al. | |
| 2021/0376508 | A1 | 12/2021 | Hu | |
| 2022/0037828 | A1 * | 2/2022 | Hu | H01R 12/721 |
| 2022/0069496 | A1 | 3/2022 | Yi et al. | |
| 2022/0181809 | A1 * | 6/2022 | Xie | H01R 12/721 |
| 2022/0181811 | A1 | 6/2022 | Liu et al. | |
| 2022/0247107 | A1 * | 8/2022 | Tang | H01R 13/6471 |

FOREIGN PATENT DOCUMENTS

| | | | |
|---|---|---|---|
| CN | 203660106 | U | 6/2014 |
| CN | 105703103 | A | 6/2016 |
| CN | 108539464 | A | 9/2018 |
| CN | 212874843 | U | 4/2021 |
| CN | 214505858 | U | 10/2021 |
| EP | 0820124 | A2 | 1/1998 |
| GB | 227943 | A | 1/1925 |
| TW | 200835073 | A | 8/2008 |
| TW | M475740 | U | 4/2014 |
| WO | WO 02/073819 | A2 | 9/2002 |

OTHER PUBLICATIONS

†U.S. Appl. No. 17/331,414, filed May 26, 2021, Hu et al.
†U.S. Appl. No. 17/402,255, filed Aug. 13, 2021, Yi et al.
†U.S. Appl. No. 17/540,062, filed Dec. 1, 2021, Liu et al.
PCT/CN2021/114671, Nov. 29, 2021, International Search Report and Written Opinion.
International Search Report and Written Opinion dated Nov. 29, 2021 for International Application No. PCT/CN2021/114671.
[No Author Listed], DDR5 SDRAM—Wikipedia. Aug. 8, 2021. 6 pages. URL:https://en.wikipedia.org/wiki/DDR5_SDRAM [last accessed on Aug. 16, 2021].
[No Author Listed], DDR5 Memory Module Sockets (SMT). Storage & Server IO. Amphenol ICC. 2022. 2 pages. URL:https://cdn.amphenol-cs.com/media/wysiwyg/files/documentation/datasheet/ssio/ssio_ddr5_smt.pdf [last accessed Mar. 22, 2022].
[No Author Listed], MCIO 124pos 85ohm. Amphenol Assembletech. 1 page. URL:http://www.amphenol-ast.com/v3/en/overview.aspx?classId=234 [retrieved on Apr. 11, 2022].
[No Author Listed], Mini Cool Edge IO—The Ideal Solution to Transmit Next Generation High-Speed Signal to Designated Area in Your System. Jul. 25, 2018. 2 pages. URL:https://www.amphenol-icc.com/connect/mini-cool-edge-io-the-ideal-solution-to-transmit-next-generation-high-speedsignal.html [retrieved on Apr. 11, 2022].
[No Author Listed], Mini Cool Edge IO Connector. Commercial IO. Amphenol ICC. 2022. 5 pages. URL:https://cdn.amphenol-icc.com/media/wysiwyg/files/documentation/datasheet/inputoutput/io_mini_cool_edge_io.pdf [retrieved on Apr. 11, 2022].
Armasu, What We Know About DDR5 So Far. Jun. 7, 2019. 20 pages. URL:https://www.tomshardware.com/news/what-we-know-ddr5-ram,39079.html [last accessed Jul. 21, 2022].

* cited by examiner

COMPACT, RELIABLE CARD EDGE CONNECTOR

CROSS-REFERENCE TO RELATED APPLICATIONS

This application claims priority to and the benefit of Chinese Patent Application Serial Nos. 202022974284.8 and 202011458813.7, filed on Dec. 11, 2020. This application also claims priority to and the benefit of Chinese Patent Application Serial Nos. 202021557848.1 and 202010756166.1, filed on Jul. 31, 2020. The entire contents of these applications are incorporated herein by reference in their entirety.

TECHNICAL FIELD

The present disclosure relates to an electrical connector.

BACKGROUND

An electrical connector in an electronic system is configured to connect circuits on one printed circuit board (PCB) to the circuits on another PCB. For some systems, it is easier and more cost-effective to manufacture most of the circuits of the system on separate electronic assemblies, for example, PCBs. The electronic assemblies may be connected together by an electrical connector. A common example is a memory card inserted into the electrical connector on a mainboard of a personal computer.

In servers and other powerful computers, multiple electrical connectors can connect multiple PCBs to the same mainboard. Under the requirement of product miniaturization, the multiple electrical connectors connecting these PCBs are arranged on the mainboard close to each other along a transverse direction in order to improve the space utilization rate.

However, the PCBs will generate heat during operation. It is expected that air is circulated freely along a channel between adjacent memory cards. The reason is that the PCBs generate the heat and it is necessary for the air cooling the mainboard to pass through the channel.

BRIEF SUMMARY

Some embodiments relate to an electrical connector. The electrical connector may include an insulating body and a reinforcing member. The insulating body may comprise a pair of side portions which extend in a longitudinal direction, and a pair of tower portions which are connected to respective ends of the pair of side portions. The pair of side portions and the pair of tower portions may form a longitudinal card slot, and the ends of the card slot extend into respective ones of the pair of tower portions. The reinforcing member may be arranged in one or both of the tower portions. A cross section of the reinforcing member may be U-shaped. An opening of the U shape may face the card slot. An end portion of the card slot may extend into the opening of the U-shape.

In some embodiments, an insertion slot may be formed in one or both of the tower portions, and the reinforcing member may be inserted into the insertion slot.

In some embodiments, the insertion slot may extend to top surfaces of the tower portions, and the reinforcing member may be inserted into the insertion slot from the top surfaces.

In some embodiments, a first step and a second step may be arranged at a bottom of the insertion slot. The first step and the second step may be spaced apart in a transverse direction, such that a first recess and a second recess are formed on two sides of the first step and the second step, respectively. A third recess may be formed between the first step and the second step. The first recess and the second recess may be respectively located on two sides of the card slot in the transverse direction. A lower portion of the reinforcing member may be adaptive with the bottom of the insertion slot.

In some embodiments, a depth of the third recess may be greater than a depth of the first recess and a depth of the second recess.

In some embodiments, the reinforcing member may comprise a transverse portion which extends in a transverse direction, as well as a first longitudinal portion and a second longitudinal portion which extend in the longitudinal direction from two ends of the transverse portion respectively. The first longitudinal portion and the second longitudinal portion may be spaced apart to form the opening of the U-shape. The reinforcing member may further comprise an elastic portion which is bent from a top of the transverse portion toward a direction away from the card slot, and the elastic portion may abut against the insertion slot.

In some embodiments, the reinforcing member may further comprise a first gripping portion and a second gripping portion which protrude upward from the top of the transverse portion. The first gripping portion and the second gripping portion may be respectively located on two sides of the elastic portion in the transverse direction.

In some embodiments, the reinforcing member may further comprise a first extending portion which extends upward from the first longitudinal portion, and a second extending portion which extends upward from the second longitudinal portion.

In some embodiments, the transverse portion and the first longitudinal portion may be connected by a first arc transition portion, and the transverse portion and the second longitudinal portion may be connected by a second arc transition portion.

In some embodiments, the card slot may comprise a card inserted groove and a pair of card locked grooves. The card inserted groove may be located between the pair of side portions and extends in the longitudinal direction. The pair of card locked grooves may be respectively located on side surfaces, facing each other, of the pair of tower portions, and extend in a vertical direction. Lower ends of the pair of card locked grooves may be respectively connected to two ends of the card inserted groove.

In some embodiments, the electrical connector may further comprise a pair of latches. The pair of latches may be respectively connected to the pair of tower portions. When the pair of latches may be correspondingly fastened to the pair of tower portions, the pair of latches may seal upper ends of the pair of card locked grooves respectively, and the reinforcing member may be wrapped by a corresponding latch and a corresponding tower portion.

In some embodiments, the reinforcing member may be an integral sheet metal piece.

In some embodiments, the electrical connector may be a card edge connector.

In some embodiments, when an electronic card is inserted into the card slot, the reinforcing member may maintain the shape of the tower portions at both sides of the electronic card in the transverse direction, so as to avoid deformation or cracking of the tower portions when the electronic card is impacted by an external force. In addition, since a vertical height of the tower portions may be greater than the vertical height of the side portions, the increased strength of the tower portions may effectively share the impact force on the side portions, and also strengthen the pair of side portions, thereby improving their impact resistances. In particular, the resistance to the impact force in the transverse direction of the side portions may be improved, thereby protecting the insulating body to a certain extent and preventing the insulating body from deforming or cracking.

Some embodiments relate to an electrical connector. The electrical connector may comprise an insulating body and a latch. The insulating body may comprise a side body extending in a longitudinal direction and a tower portion protruding upward from an end of the side body. The latch may be connected to an end of the insulating body. The latch may be configured to lock a printed circuit board when the printed circuit board is connected to the electrical connector. A transverse width of the part of the latch at least above the side body and a transverse width of the tower portion may be less than a transverse width of the side body.

In some embodiments, the electrical connector may further comprise a reinforcing member arranged on the tower portion.

In some embodiments, the insulating body may be provided with a slot extending along the longitudinal direction, the slot may be configured to receive a printed circuit board, the reinforcing member may have an opening, and an end of the slot may extend into the opening.

In some embodiments, the reinforcing member may wrap at least a part of the tower portion from the outer side of the tower portion.

In some embodiments, the reinforcing member may be embedded in the tower portion.

In some embodiments, a recess may be disposed in the tower portion, and the recess may extend to the top surface of the tower portion, so that the reinforcing member is inserted into the recess from the top of the tower portion.

In some embodiments, the insulating body may be provided with a slot extending along the longitudinal direction, the slot may be configured to receive a printed circuit board, the slot may extend from the side body to the tower portion, the tower portion may comprise a pair of side walls on both sides of the slot and an end wall at the end of the slot, the recess may comprise a pair of side recesses in the pair of side walls respectively and an end recess in the end wall, and the end recesses may be connected between the pair of side recesses.

In some embodiments, the bottom surface of one or both of the pair of side recesses may be provided with a first groove recessed downward, the reinforcing member may comprise a reinforcing body and a first protrusion extending downward from the bottom of the reinforcing body, and the first protrusion may be clamped into the first groove.

In some embodiments, a notch may be disposed in the top surface of one or both of the pair of side walls. The notch and the side recess in the side wall where the notch is located may be adjacent to and communicated with each other along the longitudinal direction. The reinforcing member may comprise a reinforcing body and a hook. The reinforcing body may have an U shape. An opening of the U shape may face an opposite tower portion. The hook may extend from the edge of the opening of the U shape toward the inner of the opening of the U shape. The hook may be disposed in the notch.

In some embodiments, the bottom of the notch may be provided with a second groove.

The reinforcing member may further comprises a second protrusion extending downward from the bottom of the hook. The second protrusion may be clamped into the second groove.

In some embodiments, the top of the hook may be provided with a chamfer.

In some embodiments, the top of the reinforcing member may be provided with a hand-held portion.

In some embodiments, the hand-held portion may comprise a first hand-held groove and a second hand-held groove which are disposed at an interval.

In some embodiments, the reinforcing member may be disposed on the upper part of the tower portion.

In some embodiments, when the latch is in a locking position of locking a printed circuit board, the latch may extend to the inner of the tower portion to engage with the tower portion.

In some embodiments, an engagement hole may be disposed in the side surface of the tower portion facing the latch. The latch may extend into the engagement hole to engage with the engagement hole when in the locking position.

In some embodiments, the engagement hole may penetrate the tower portion along the longitudinal direction.

In some embodiments, the latch may be provided with a through hole extending along the longitudinal direction. The through hole may be communicated with the engagement hole.

In some embodiments, the latch may be provided with a third protrusion. The third protrusion may extend into the engagement hole to engage with the engagement hole when the latch is in the locking position.

In some embodiments, a transverse width of the upper part of the latch may be greater than a transverse width of the lower part of the latch. The upper part of the latch may be configured to lock the printed circuit board. The third protrusion may be disposed on the lower part of the latch.

In some embodiments, the transverse width of the upper part of the latch may be equal to the transverse width of the tower portion.

In some embodiments, the electrical connector may be a card edge connector.

Some embodiments relate to an electronic system. The electronic system may include any one of the electrical connectors described above and a first printed circuit board. The first printed circuit board may be connected to the electrical connector. The latch may lock the first printed circuit board to the electrical connector.

In some embodiments, the electronic system may further comprise a second printed circuit board. A plurality of the electrical connectors may be provided. The electrical connectors may be arranged side by side on the second printed circuit board along the transverse direction.

In some embodiments, the transverse width of the part of the latch at least above the side body and the transverse width of the tower portion may be less than the transverse width of the side body. Even if the electrical connectors are arranged close to each other along the transverse direction, an air circulation channel may be formed between adjacent electrical connectors. Therefore, a better heat dissipation effect may be achieved, and the performance of the electronic system using the electrical connector may be more stable. The electrical connector may be particularly suitable for places where the ventilation environment is poor, the electrical connector may work for a long time, and the electronic system may generate a large amount of heat.

The foregoing aspects may be used separately or together, in a combination of two or more aspects. Features and advantages of the present disclosure are described in detail below with reference to the accompanying drawings.

BRIEF DESCRIPTION OF DRAWINGS

The following accompanying drawings of the present disclosure are used here as a part of the present disclosure for understanding the present disclosure. The embodiments and their descriptions of the present disclosure are illustrated in the accompanying drawings to explain the principle of the present disclosure. In drawings.

Figure 1:
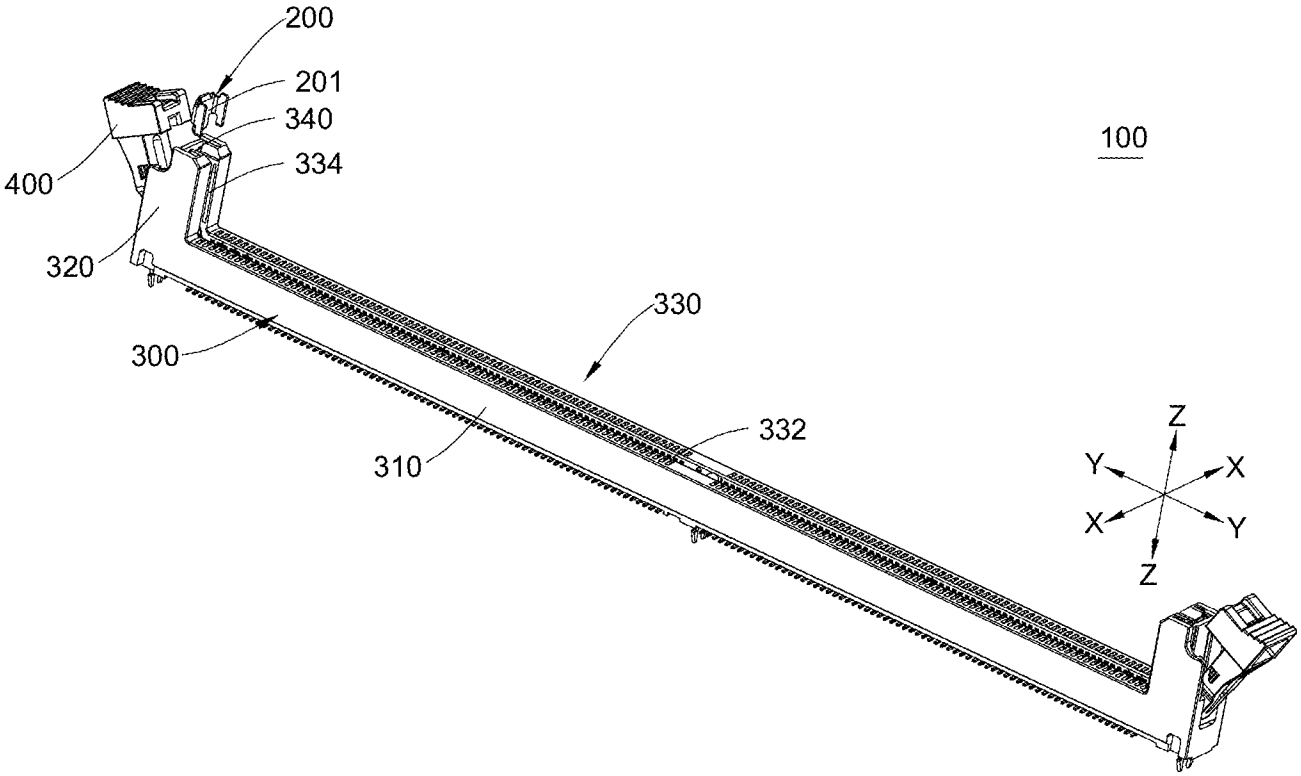
FIG. 1 is a perspective view of an electrical connector according to an exemplary embodiment of the present disclosure, in which a reinforcing member is not installed to an insulating body.

The above accompanying drawings include the following reference symbols:

100—electrical connector; 200—reinforcing member; 201—opening; 210—transverse portion; 221—first longitudinal portion; 222—second longitudinal portion; 230—elastic portion; 241—first gripping portion; 242—second gripping portion; 251—first extending portion; 252—second extending portion; 261—first arc transition portion; 262—second arc transition portion; 271—first protrusion; 272—second protrusion; 273—third protrusion; 300—insulating body; 310—side portion; 320—tower portion; 330—card slot; 332—card inserted groove; 334—card locked groove; 340—insertion slot; 351—first step; 352—second step; 361—first recess; 362—second recess; 363—third recess; 400—latch.

1100, electrical connector; 1200, reinforcing member; 1201, opening; 1211, first protrusion; 1212, second protrusion; 1213, third protrusion; 1220, reinforcing body; 1230, hook; 1231, chamfer; 1240, hand-held portion; 1241, first hand-held groove; 1242, second hand-held groove; 1300, insulating body; 1301, slot; 1302, conductor; 1310, side body; 1320, tower portion; 1330, recess; 1331, side recess; 1332, end recess; 1341, side wall; 1342, end wall; 1351, first groove; 1352, second groove; 1360, notch; 1370, pivot hole; 1380, engagement hole; 1381, engaging portion; 1400, latch; 1410, pivot shaft; 1420, through hole; 1500, electronic card.

DETAILED DESCRIPTION

The inventors have recognized and appreciated designs for electrical connectors that contribute to reliable performance of systems using those electrical connectors. In some systems, a performance advantage may be achieved by making connectors narrower than conventional connectors. However, in a card edge connector, making the connector narrower can increase the likelihood that the connector will be damaged by a force applied to the connector as a result of vibration or other operating conditions of the system.

For example, in a system in which multiple PCBs are mounted to a mainboard in parallel with channels for cooling air to flow between the PCBs, the connectors may constrict those channels and interface with the airflow. As a result, the heat generated by the PCBs is not efficiently diffused through the channel, which may cause adverse effects in the operation of the connectors due to overheating of the PCBs. However, making the connectors narrower, so that the channels can be wider, may lead to an unacceptable risk of cracking in the connector housing. Techniques as described herein may yield a robust electrical connector, which may be used even in connectors that are relatively narrow to enhance airflow through channels adjacent the connectors.

In the following description, numerous details are provided to enable a thorough understanding of the present disclosure. However, a person skilled in the art may understand that the following description only exemplarily shows the preferred embodiments of the present disclosure, and the present disclosure may be implemented without one or more such details. In addition, in order to avoid confusion with the present disclosure, some technical features known in the art have not been described in detail.

As shown in FIGS. 1-5, the present disclosure provides an electrical connector 100. The electrical connector 100 may include an insulating body 300 and a reinforcing member 200. The electrical connector 100 may be a card edge connector. The card edge connector may be configured to connect an electronic card. The insulating body 300 may be installed to a component such as a circuit board.

Figure 2:
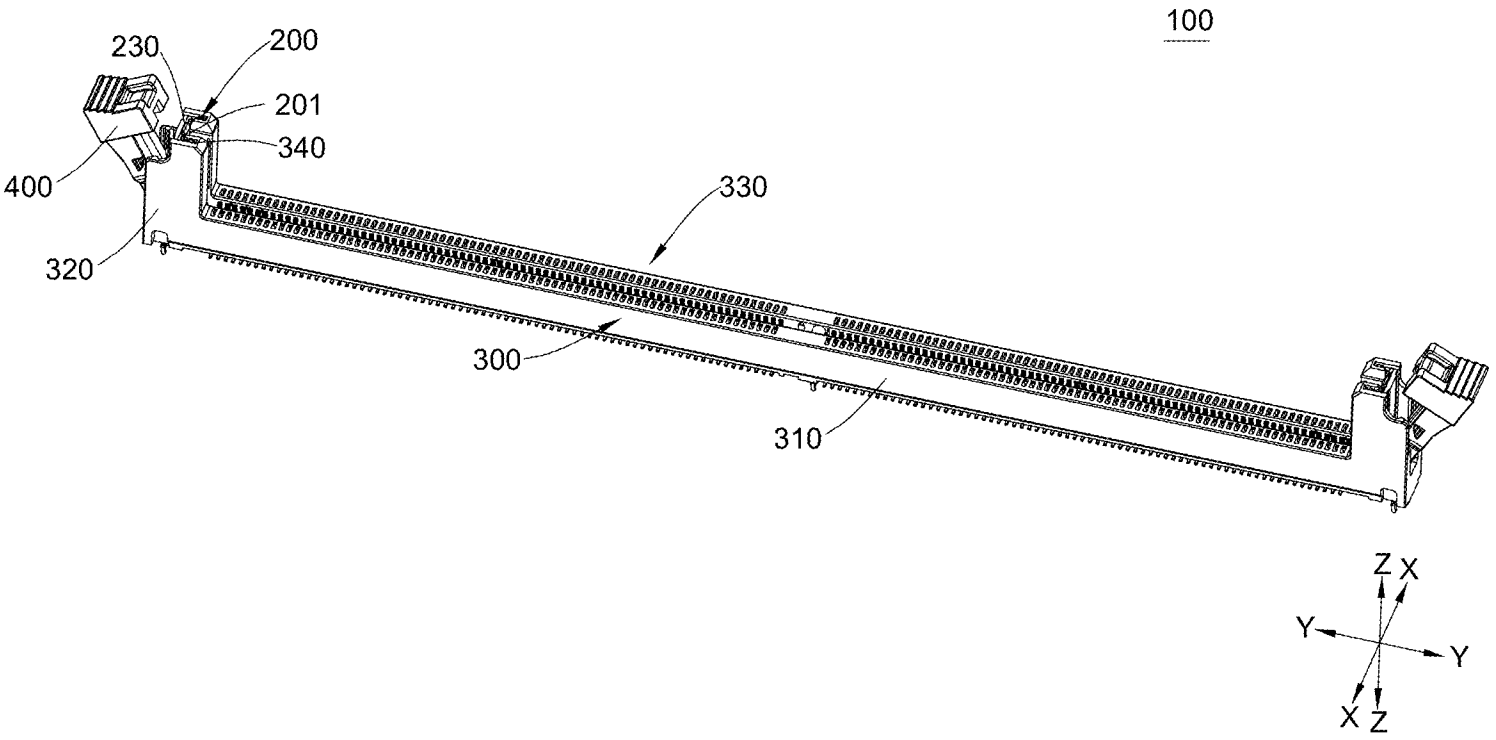
FIG. 2 is a perspective view of the electrical connector shown in FIG. 1 from another perspective, in which the reinforcing member is installed to the insulating body.

As shown in FIGS. 1-2, the insulating body 300 may include a pair of side portions 310 and a pair of tower portions 320. The pair of side portions 310 may extend in a longitudinal direction Y-Y. In the drawings, Y-Y represents a longitudinal direction (i.e., a length direction) of the electrical connector 100; X-X represents a transverse direction (i.e., a width direction) of the electrical connector 100; and Z-Z represents a vertical direction (i.e., a height direction) of the electrical connector 100. The transverse direction X-X, the longitudinal direction Y-Y, and the vertical direction Z-Z are perpendicular to each other. The pair of tower portions 320 may be connected to two ends of the pair of side portions 310, respectively. The tower portions 320 may extend in the vertical direction Z-Z. The pair of side portions 310 and the pair of tower portions 320 may enclose to form a longitudinal card slot 330. The card slot 330 extends substantially in the longitudinal direction Y-Y. Both ends of the card slot 330 extend into the pair of tower portions 320, respectively. That is, the length of the card slot 330 is greater than that of the side portions 310 in the longitudinal direction Y-Y, so that both ends of the card slot 330 extend beyond the side portions 310 and into the tower portions 320. On the whole, the card slot 330 is recessed from the top surface of the insulating body 300 to receive an electronic card. The "top" refers to a side away from a circuit board and more convenient for operation. The "bottom" refers to a side close to the circuit board. The electronic card may be inserted into the card slot 330 in the vertical direction Z-Z. The electronic card may include any one of a graphics card, a memory card, and a sound card.

Figure 4:
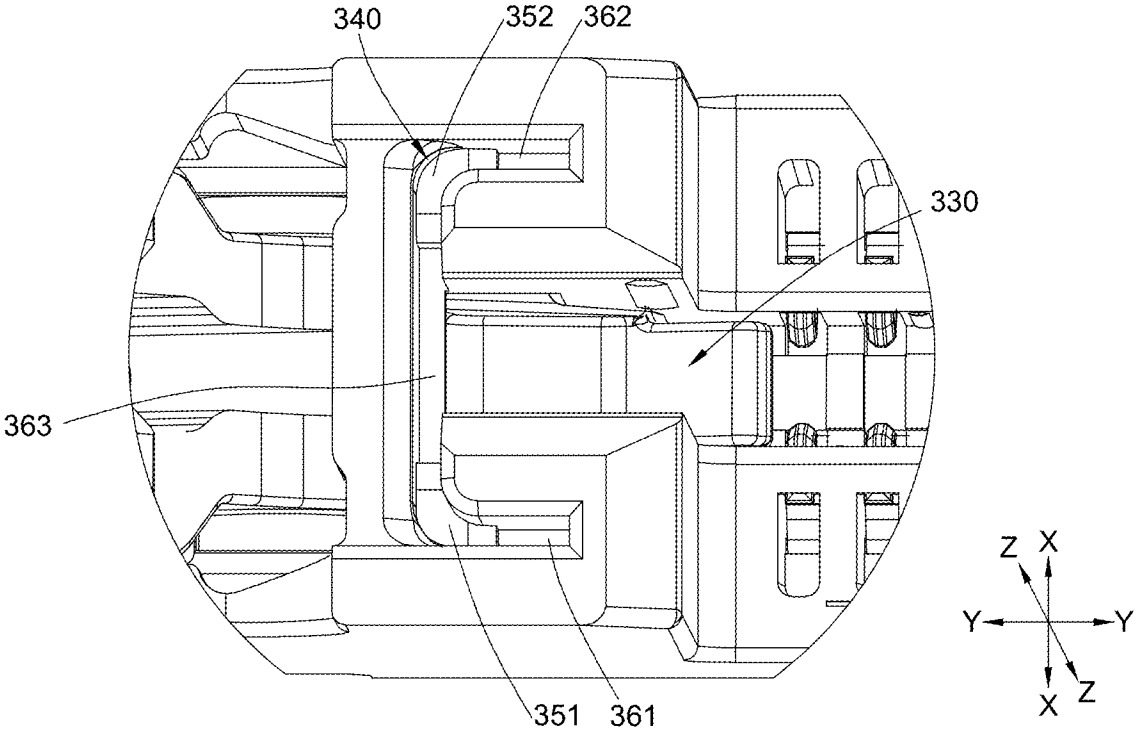
FIG. 4 is a partial enlarged view of the insulating body shown in FIG. 3.

A reinforcing member(s) 200 is arranged in one or both of the tower portions 320. In an exemplary embodiment, an insertion slot 340 may be formed in one or both of the tower portions 320 correspondingly. The reinforcing member 200 may be inserted into a corresponding insertion slot 340. The reinforcing member 200 may be made of a high-strength material, such as plastic, ceramic, metal and so on. In some embodiments, the reinforcing member 200 is made of a metal material. The metal material has higher strength, and lower material cost and processing cost. In some embodiments, the reinforcing member 200 is an integral sheet metal piece. In this way, the reinforcing member 200 has higher strength, accompanied with simpler processing technology and lower cost. A cross section of the reinforcing member 200 is U-shaped. The cross section refers to a section which is formed by cutting the reinforcing member 200 with a plane perpendicular to the vertical direction Z-Z. An opening 201 of the U shape may face the card slot 330. The end portion of the card slot 330 may extend into the opening 201 of the U-shape. Two ends of the U shape are respectively located on two sides of the card slot 330 in the transverse direction X-X. That is, when viewed in the vertical direction Z-Z, the reinforcing member 200 surrounds the end portion of the card slot 330. The shape of the reinforcing member 200 may be adaptive with that of the insertion slot 340. As shown in FIG. 4, the insertion slot 340 surrounds the end portion of the card slot 330, such that the reinforcing member 200 surrounds the end portion of the card slot 330. Optionally, the reinforcing member 200 may be arranged only in one tower portion 320; or two reinforcing members 200 may be arranged in the two tower portions 320, respectively. More ideally, two reinforcing members 200 are arranged in the two tower portions 320 respectively, such that the two reinforcing members 200 surround two ends of the card slot 330, respectively.

The card slot 330 extends into the tower portions 320, which affects the strength of the tower portions 320. By providing the reinforcing members 200 in the tower portions 320, the tower portions 320 can be strengthened to improve the impact resistance. Especially in a card edge connector, a longitudinal length of the entire card slot 330 is obviously greater than a horizontal width. The tower portions 320 are likely to deform or crack when subjected to an impact force in the transverse direction X-X. Therefore, further, the end portions of the card slot 330 extend into the opening 201 of the U-shaped reinforcing member 200. In this way, when the electronic card is inserted into the card slot 330, the reinforcing member 200 can maintain the shape of the tower portions 320 at the ends of the electronic card in the transverse direction X-X, so as to avoid deformation or cracking of the tower portions 320 when the electronic card is impacted by an external force. In addition, since the vertical height of the tower portions 320 may be greater than the vertical height of the side portions 310, the increased strength of the tower portions 320 can effectively share the impact force on the side portions 310, and also strengthen the pair of side portions 310, thereby improving their impact resistances. In particular, the resistance to the impact force in the transverse direction X-X can be improved, thereby protecting the insulating body 300 to a certain extent and preventing the insulating body 300 from deforming or cracking.

The reinforcing member 200 may be inserted into the insertion slot 340 in any suitable direction, such as the longitudinal direction Y-Y (not shown) or the vertical direction Z-Z (as shown). When the reinforcing member 200 is installed into the tower portions 320 in different directions, the insertion slot 340 may have different shapes and structures. When the reinforcing member 200 is inserted into the insertion slot 340 in the longitudinal direction Y-Y, the insertion slot 340 may extend to the outer side surface of the tower portions 320 in the longitudinal direction Y-Y. In this way, the reinforcing member 200 may be inserted into the insertion slot 340 from the outer side surface. When the reinforcing member 200 is inserted into the insertion slot 340 in the vertical direction Z-Z, the insertion slot 340 may extend to the top surface or the bottom surface of the tower portions 320 in the vertical direction Z-Z. In this way, the reinforcing member 200 may be inserted into the insertion slot 340 from the top surface or the bottom surface.

The insulating body 300 and the reinforcing member 200 are made of different materials. The reinforcing member 200 is inserted into the insertion slot 340. The insulating body 300 and the reinforcing member 200 can be separately manufactured and then assembled, thereby facilitating manufacturing and installation, and reducing the cost of the electrical connector 100.

Optionally, the reinforcing member 200 may be installed in the tower portions 320 in a non-plugging manner, and instead may be sealed in the insulating body 300 while the insulating body 300 is molded. However, this may result in higher cost for opening a mold of the insulating body 300.

Further, as shown in FIGS. 1-2, the insertion slot 340 extends to the top surfaces of the tower portions 320. The reinforcing member 200 is inserted into the insertion slot 340 from the top surfaces. Since the top surface of each of the tower portions 320 refers to a side where the electronic card is inserted into the card slot 330, and this side has a larger field of view and operation space, the reinforcing member 200 can be inserted into the insertion slot 340 from the top surface, which is convenient to operate and achieves better user experience. In addition, whether the reinforcing member 200 is properly inserted into the insertion slot 340 can also be checked from the top surface.

Figure 3:
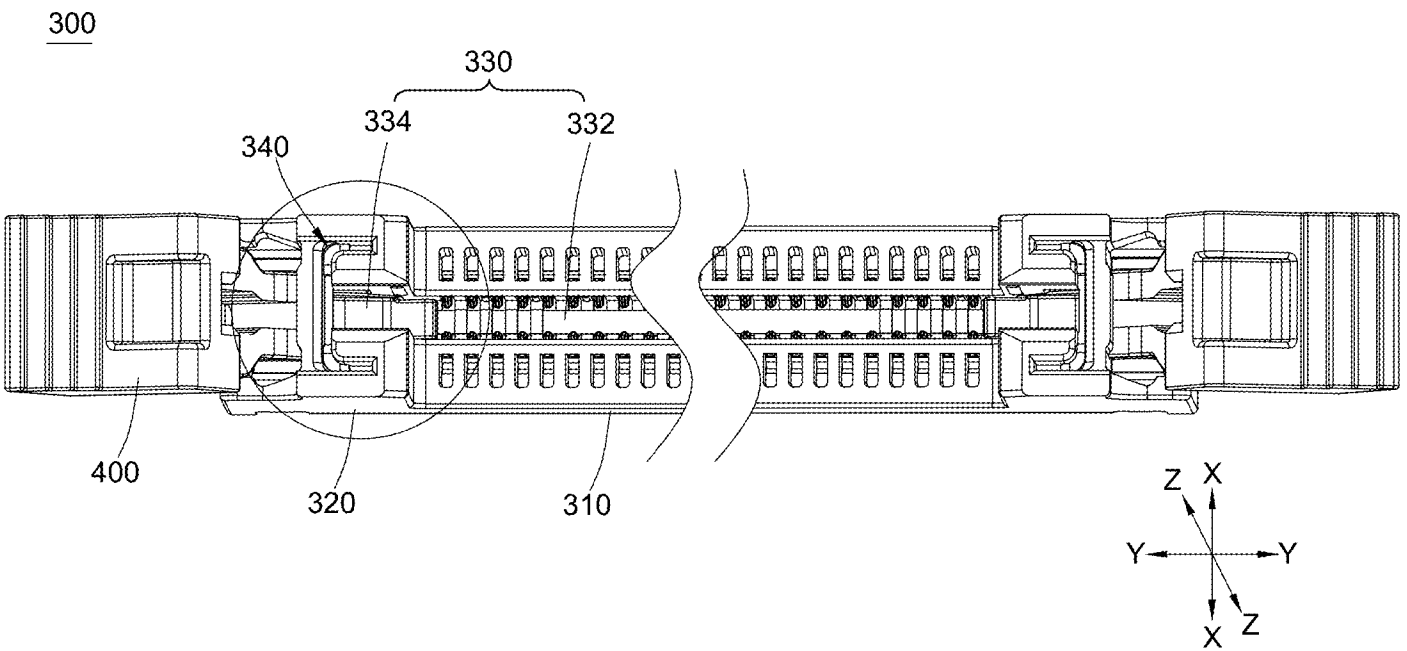
FIG. 3 is a perspective view of the insulating body shown in FIG. 1.
Figure 5:
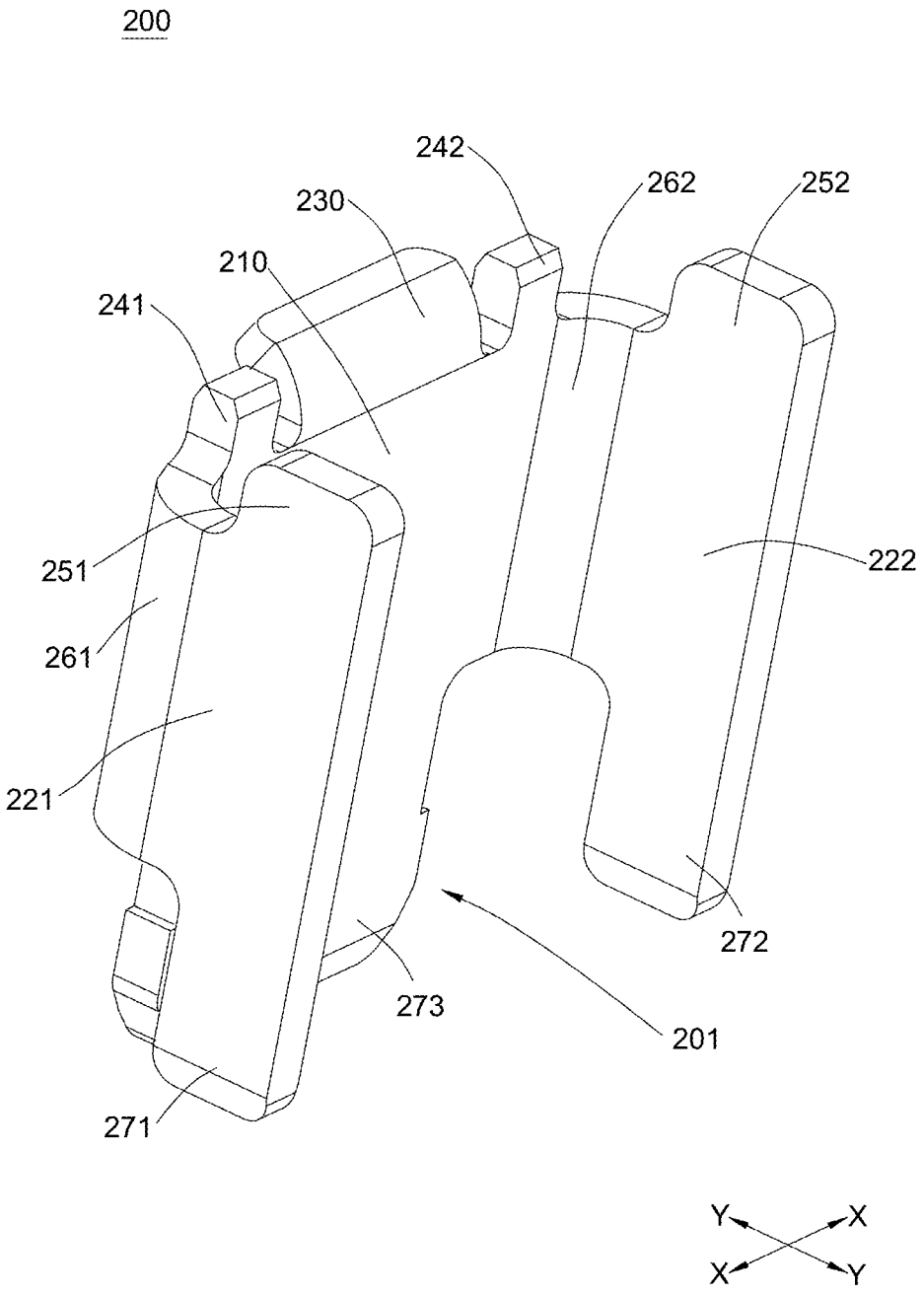
FIG. 5 is a perspective view of the reinforcing member shown in FIG. 1.

In some embodiments, as shown in FIGS. 3-4, a first step 351 and a second step 352 may be arranged at the bottom of the insertion slot 340. The first step 351 and the second step 352 may be spaced apart in the transverse direction X-X. A first recess 361 and a second recess 362 are respectively formed on two sides of the first step 351 and the second step 352. A third recess 363 is formed between the first step 351 and the second step 352. The first recess 361 and the second recess 362 may be respectively located on two sides of the card slot 330 in the transverse direction X-X. The lower portion of the reinforcing member 200 may be adaptive with the bottom of the insertion slot 340. Correspondingly, as shown in FIG. 5, the lower portion of the reinforcing member 200 may be provided with a first protrusion 271, a second protrusion 272 and a third protrusion 273. The first protrusion 271, the second protrusion 272, and the third protrusion 273 are inserted into the first recess 361, the second recess 362, and the third recess 363, respectively. The first step 351 and the second step 352 may be same or different in shape and size. The first recess 361 and the second recess 362 may be same or different. With the first step 351 and the second step 352, the thickness of the bottoms of the tower portions 320 can be increased, the structural strength of the tower portions 320 can be improved, and the reinforcing member 200 can be better supported to be prevented from impacting the circuit board. In addition, with the first recess 361, the second recess 362, and the third recess 363, the size of the reinforcing member 200 in the vertical direction Z-Z can be extended as much as possible, and the insulating body 300 can be protected to a large extent from deforming or cracking.

Further, as shown in FIGS. 3-4, the depth of the third recess 363 may be greater than the depth of the first recess 361 and the depth of the second recess 362. In this way, an insertion depth of a main portion of the reinforcing member 200 can be increased, which is beneficial to increase the vertical height of the opening 201, ensure the interference force of the reinforcing member 200, and protect the tower portions 320 to a large extent from deforming or cracking.

Optionally, the depth of the third recess 363 may be less than or equal to the depth of the first recess 361 and the depth of the second recess 362.

In some embodiments, as shown in FIG. 5, the reinforcing member 200 may include a transverse portion 210, a first longitudinal portion 221 and a second longitudinal portion 222. The transverse portion 210 extends in the transverse direction X-X. The first longitudinal portion 221 and the second longitudinal portion 222 extend in the longitudinal direction Y-Y from two ends of the transverse portion 210 respectively. The first longitudinal portion 221 and the second longitudinal portion 222 may be same or different. The first longitudinal portion 221 and the second longitudinal portion 222 are spaced apart to form the opening 201 of the U-shape. The aforementioned first protrusion 271, the second protrusion 272, and the third protrusion 273 may be arranged on the transverse portion 210, the first longitudinal portion 221 and the second longitudinal portion 222, respectively. The reinforcing member 200 may further include an elastic portion 230. The elastic portion 230 is bent from the top of the transverse portion 210 toward a direction away from the card slot 330. A curvature radius of the elastic portion 230 may be arbitrary. The elastic portion 230 may abut against the insertion slot 340. In an exemplary embodiment, the first longitudinal portion 221, the second longitudinal portion 222, the elastic portion 230 and the transverse portion 210 may be spliced together by means of, for example, welding, bonding, etc., or may be integrally formed. The elastic portion 230 can play a guiding role. When the electronic card is inserted into the card slot 330 in the vertical direction Z-Z, the elastic portion 230 can protect the electronic card from being scratched. The electronic card can be effectively inserted into the card slot 330.

Optionally, as shown in FIG. 5, the reinforcing member 200 may further include a first gripping portion 241 and a second gripping portion 242. The first gripping portion 241 and the second gripping portion 242 protrude upward from the top of the transverse portion 210. The first gripping portion 241 and the second gripping portion 242 may be located on two sides of the elastic portion 230 in the transverse direction X-X, respectively. The first gripping portion 241 and the second gripping portion 242 may be same or different. In an exemplary embodiment, the first gripping portion 241 and the transverse portion 210, as well as the second gripping portion 242 and the transverse portion 210 may be spliced together by means of, for example, welding, bonding, etc., or may be integrally formed. The first gripping portion 241 and the second gripping portion 242 may be used to connect a terminal strip, and a related person can insert the reinforcing member 200 into the insertion slot 340 more comfortably by grasping the terminal strip, which is convenient for installation. The terminal strip may be removed after installation.

Optionally, as shown in FIG. 5, the reinforcing member 200 may further include a first extending portion 251 and a second extending portion 252. The first extending portion 251 and the second extending portion 252 extend upward from the first longitudinal portion 221 and the second longitudinal portion 222, respectively. The first extending portion 251 and the second extending portion 252 may be same or different. In an exemplary embodiment, the first extending portion 251 and the first longitudinal portion 221, as well as the second extending portion 252 and the second longitudinal portion 222 may be spliced together by means of, for example, welding, bonding, etc., or may be integrally formed. The first extending portion 251 and the second extending portion 252 can increase a vertical size of the reinforcing member 200 as much as possible so as to enhance the resistance of the reinforcing member 200 to an impact force, so that the insulating body 300 can be better protected from deforming or cracking.

Optionally, as shown in FIG. 5, the transverse portion 210 and the first longitudinal portion 221 may be connected by a first arc transition portion 261. The transverse portion 210 and the second longitudinal portion 222 may be connected by a second arc transition portion 262. A curvature radius of the first arc transition portion 261 and a curvature radius of the second arc transition portion 262 may be arbitrary. In this way, the reinforcing member 200 is easily processed and formed from a plate, and the production cost thereof is relatively lower.

In the illustrated embodiment, as shown in FIGS. 1 and 3, the card slot 330 may include a card inserted groove 332 and a pair of card locked grooves 334. The card inserted groove 332 is located between the pair of side portions 310, and extends in the longitudinal direction Y-Y. A conductive member is generally arranged in the side portions 310 and configured to electrically connect the electronic card with the circuit board. The pair of card locked grooves 334 is respectively located on side surfaces of the pair of tower portions 320. The side surfaces face each other. The pair of card locked grooves 334 extend in the vertical direction Z-Z. The lower ends of the pair of card locked grooves 334 are respectively connected to two ends of the card inserted groove 332. In this way, the card slot 330 is formed to be U-shaped.

In some embodiments, as shown in FIGS. 1-2, the electrical connector 100 may further include a pair of latches 400. The pair of latches 400 may be connected to the pair of tower portions 320 respectively. The latches 400 may be detachably or pivotally connected to the tower portions 320. When the latches 400 are fastened to the tower portions 320, the latches 400 seal the upper ends of the card locked grooves 334. The card locked grooves 334 cooperate with the latches 400 so as to lock the electronic card on the electrical connector 100 firmly. As a result, the electronic card can no longer be pulled out. In this case, the reinforcing member 200 is wrapped by a corresponding latch 400 and a corresponding tower portion 320. Therefore, it is possible to ensure that the reinforcing member 200 cannot be contaminated by external dust and other dirt, and cannot be oxidized, etc., thereby ensuring the structural strength of the reinforcing member 200 and better protecting the insulating body 300.

According to one aspect of the present disclosure, an electrical connector is provided. The electrical connector may interconnect the PCBs, for example a mainboard and a daughter card, in an electronic system.

As shown in FIG. 6 to FIG. 9, the electrical connector 1100 may include an insulating body 1300 and a latch 1400.

The insulating body 1300 may include a side body 1310 and a tower portion 1320. The side body 1310 may extend along a longitudinal direction X-X. In the accompanying drawings, X-X represents the longitudinal direction (i.e., a length direction) of the electrical connector 1100. Y-Y represents a transverse direction (i.e., a width direction) of the electrical connector 1100. Z represents a vertical direction (i.e., a height direction) of the electrical connector 1100. The longitudinal direction X-X, the transverse direction Y-Y, and the vertical direction Z are perpendicular to each other. The ends of the side body 1310 along the longitudinal direction X-X may be provided with the tower portions 1320 protruding upward. The orientations used herein are in terms of a placement state of the electrical connector 1100 shown in FIG. 6 and FIG. 7. That is, the side that a first printed circuit board (for example, an electronic card 1500) is connected thereto is an upper side, and the opposite side (that is, the side facing the mainboard) is a lower side. Optionally, the insulating body 1300 may be provided with a slot 1301 extending along the longitudinal direction X-X. The slot 1301 may extend from the side body 1310 to the tower portions 1320 along the longitudinal direction X-X. The slot 1301 may be configured to receive the first printed circuit board, for example the electronic card 1500. In other words, along the longitudinal direction X-X, both ends of the slot 1301 extend into the tower portions 1320. In this way, the tower portion 1320 can increase connection strength after the first printed circuit board is inserted into the slot 1301. The first printed circuit board can be easily connected to the insulating body 1300 by the slot 1301, and the structural strength of connection is relatively high. Of course, the slot 1301 is not necessary, and the first printed circuit board may also be connected to the insulating body 1300 in other ways.

A plurality of conductors 1302 may be disposed on the side body 1310. The plurality of conductors 1302 are disposed at an interval along the longitudinal direction X-X to ensure that the conductors 1302 are electrically insulated from each other. The front surface of the side body 1310 may expose front ends of the plurality of conductors 1302. In this way, when the electrical connector 1100 is connected to the first printed circuit board, the front ends of the conductors 1302 may be electrically coupled with conductors on the first printed circuit board. The back surface of the side body 1310 may expose rear ends of the plurality of conductors 1302, so that when the electrical connector 1100 is mounted on a second printed circuit board (not shown), the plurality of conductors 1302 are electrically coupled with conductors on the second printed circuit board. The second printed circuit board is usually the mainboard.

Figure 6:
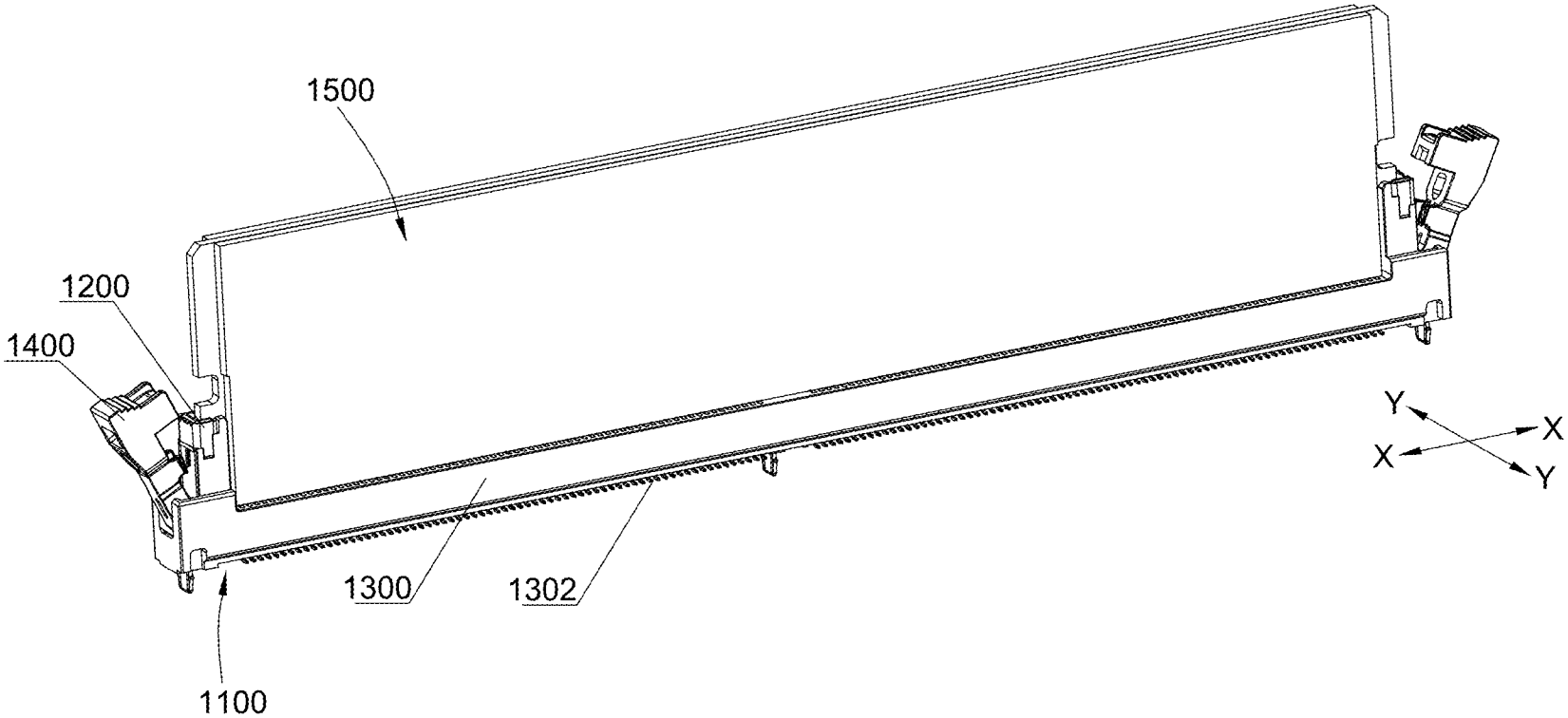
FIG. 6 is a perspective view of an electronic system according to an exemplary embodiment of the present disclosure, in which a latch is not fastened to a tower portion.
Figure 7:
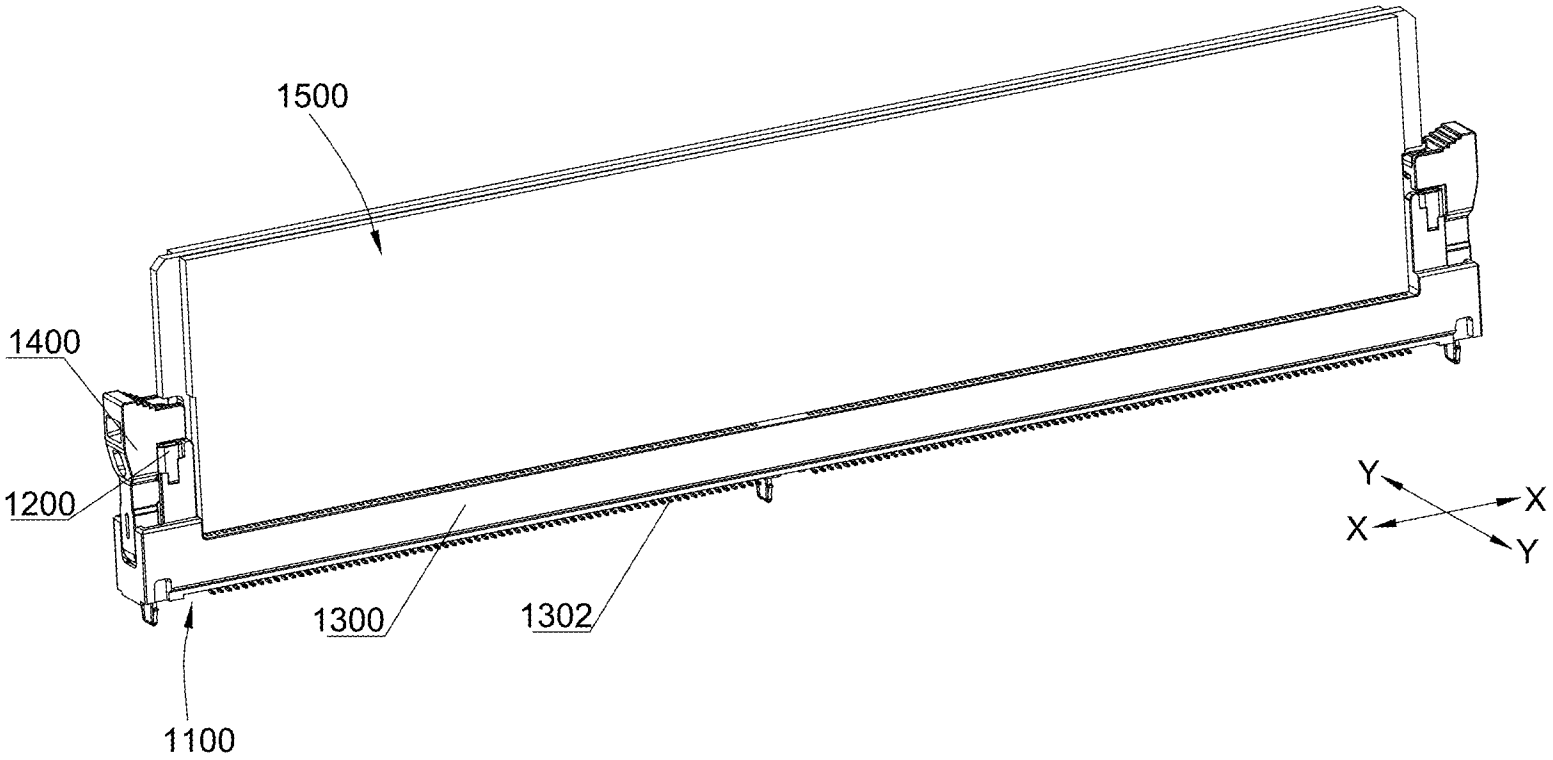
FIG. 7 is a perspective view of the electronic system shown in FIG. 6, in which the latch is fastened to the tower portion.

The latch 1400 may be connected to the end of the insulating body 1300. As known to those skilled in the art, two latches 1400 may be configured to clamp the first printed circuit board from both sides, thereby ensuring that the first printed circuit board is firmly locked onto the electrical connector 1100. In the embodiments shown in FIG. 10 to FIG. 12, the latch 1400 may be provided with a pivot shaft 1410, and the insulating body 1300 may be provided with a pivot hole 1370. By inserting the pivot shaft 1410 into the pivot hole 1370, the latch 1400 may pivot relative to the insulating body 1300. In some embodiments, the pivot hole 1370 may be disposed in the side body 1310, and the lower end of the latch 1400 is pivotally connected to the side body 1310. The lower end of the latch 1400 may be inserted into the side body 1310 to be pivotally connected thereto. Along the longitudinal direction X-X, a pair of latches 1400 is respectively located on the outer side of a pair of tower portions 1320. When the latches 1400 is in a locking position of locking the first printed circuit board, the latches 1400 may also be fixed to the corresponding tower portions 1320, so that the position of the latches 1400 relative to the insulating body 1300 is fixed. In use, as shown in FIG. 6, at first, the latches 1400 are pivoted to an open position relative to the insulating body 1300. Then the electronic card 1500 is inserted into the slot 1301. Afterwards, the latches 1400 are pivoted to the locking position relative to the insulating body 1300, so as to lock the electronic card 1500 to the electrical connector 1100. In other embodiments not shown, the latches 1400 may also be connected to the insulating body 1300 by any suitable means such as plug-in connection and latch fit.

A transverse width of a part of the latch 1400 at least above the side body 1310 may be less than a transverse width of the side body 1310. In addition, a transverse width of the tower portion 1320 may be less than the transverse width of the side body 1310.

By taking a memory card adopting a DDR5 standard as an example, the transverse width of the insulating body 1300 is about 6.5 mm. Therefore, in some embodiments, the transverse width of the part of the latch 1400 at least above the side body 1310 and the transverse width of the tower portion 1320 may be less than 6 mm. Further, the transverse width of the part of the latch 1400 at least above the side body 1310 and the transverse width of the tower portion 1320 may be less than 5.5 mm. Furthermore, the transverse width of the part of the latch 1400 at least above the side body 1310 and the transverse width of the tower portion 1320 may be less than 5 mm. Furthermore, the transverse width of the part of the latch 1400 at least above the side body 1310 and the transverse width of the tower portion 1320 may be less than 4.5 mm. Furthermore, the transverse width of the part of the latch 1400 at least above the side body 1310 and the transverse width of the tower portion 1320 may be less than 4.2 mm. In the embodiment shown in the figures, furthermore, the transverse width of the part of the latch 1400 at least above the side body 1310 and the transverse width of the tower portion 1320 are about 4.1 mm.

According to another aspect of the present disclosure, an electronic system is also provided. The electronic system may include any electrical connector 1100 herein and a first printed circuit board, for example, the electronic card 1500. The electronic card 1500 is connected to the electrical connector, and the latch 1400 may lock the electronic card 1500 to the electrical connector 1100.

When a plurality of electronic cards 1500 need to be connected to the mainboard, a plurality of electrical connectors 1100 may be provided. Each electrical connector 1100 is connected to one electronic card 1500. These electrical connectors 1100 are arranged side by side on the second printed circuit board (for example, a mainboard) along the transverse direction Y-Y.

By taking the foregoing embodiment as an example, when the electronic system using the electrical connector 1100 works, the electronic card 1500 and the mainboard can generate heat. Since the transverse width of the part of the latch 1400 at least above the side body 1310 and the transverse width of the tower portion 1320 are less than the transverse width of the side body 1310, even if these electrical connectors 1100 are arranged close to each other along the transverse direction, there are gaps between latches 1400 and between tower portions 1320 above side bodies 1310 of adjacent electrical connectors 1100. Air may flow between the electronic cards 1500 through the gaps. Therefore, the heat of the electronic cards 1500 and the mainboard is taken away to cool the electronic cards 1500. The electronic card 1500 cannot overheat, which prevents the electronic card 1500 from fault or damage and ensures normal working of the electronic system.

In order to ensure air circulation, along the transverse direction Y-Y, in some embodiments, a center-to-center distance between adjacent electrical connectors 1100 is at least greater than the transverse width of the parts of the latches 1400 at least above the side bodies 1310 and the transverse width of the tower portions 1320 by 25%. Further, the center-to-center distance between adjacent electrical connectors 1100 is at least greater than the transverse width of the parts of the latches 1400 at least above the side bodies 1310 and the transverse width of the tower portions 1320 by at least 30%. Furthermore, the center-to-center distance between adjacent electrical connectors 1100 is at least greater than the transverse width of the parts of the latches 1400 at least above the side bodies 1310 and the transverse width of the tower portions 1320 by 35%.

It is understandable that even if there is only one electrical connector 1100 in the electronic system, air circulation around the electronic card 1500 is also better, since the transverse width of the part of the latch 1400 at least above the side body 1310 and the transverse width of the tower portion 1320 are less than the transverse width of the side body 1310. Therefore, the heat dissipation effect of the electronic card 1500 is also better.

Therefore, in the electrical connector 1100 according to the present disclosure, the transverse width of the part of the latch 1400 at least above the side body 1310 and the transverse width of the tower portion 1320 are less than the transverse width of the side body 1310. Even if the electrical connectors 1100 are arranged close to each other along the transverse direction, an air circulation channel can still be formed between adjacent electrical connectors 1100, thereby achieving a better heat dissipation effect. The performance of the electronic system using the electrical connector 1100 can be more stable. The electrical connector 1100 is particularly suitable for the places where the ventilation environment is poor, the electrical connector 1100 works for a long time, and the electronic system generates more heat.

In some embodiments, the electrical connector 1100 may be a card edge connector.

The card edge connector may be configured to connect an electronic card 1500. The electronic card 1500 may include any of a graphics card, a memory card, a sound card and the like. The electronic card 1500 is generally elongated, and heat dissipation at its middle portion in the longitudinal direction X-X is poor. Therefore, it is particularly important to improve the ventilation effect on both sides of the card edge connector.

The transverse width of the part of the latch 1400 at least above the side body 1310 and the transverse width of the tower portion 1320 are less than the transverse width of the side body 1310, which may reduce a mechanical strength of the insulating body 1300.

In order to improve the mechanical strength of the insulating body 1300, as shown in FIG. 6 to FIG. 9, the electrical connector 1100 may further include a reinforcing member 1200. The reinforcing member 1200 may be made of a material with greater strength, such as plastic, ceramic and metal. In some embodiments, the reinforcing member 1200 is made of the metal. The metal has greater strength and lower material processing cost. In some embodiments, the reinforcing member 1200 is an integral sheet metal part. In this way, the reinforcing member 1200 has higher strength, manufacturing procedure is simple and its cost is lower. The reinforcing member 1200 may be disposed on the tower portion 1320 by any suitable means, such as bonding, clamping or the like. In an optional embodiment, the reinforcing member 1200 may be enclosed in the insulating body 1300 when the insulating body 1300 is molded, which, however, may result in a higher mold cost of the insulating body 1300. In some embodiments, the reinforcing member 1200 may have an opening 1201. Optionally, a cross section of the reinforcing member 1200 is U-shaped, V-shaped, or the like. The cross section is a section formed by cutting the reinforcing member 1200 with a plane perpendicular to the vertical direction Z. In the embodiment in which a slot 1301 is disposed in the insulating body 1300, the end of the slot 1301 may extend into the opening 1201.

By disposing the reinforcing member 1200 on the tower portion 1320, the tower portion 1320 may be reinforced to improve an impact resistance. A longitudinal length of the entire insulating body 1300 is significantly greater than the transverse width. Once there is an impact force along the transverse direction Y-Y, especially when the electronic card 1500 is inserted into the slot 1301, the tower portion 1320 is very easily deformed or cracked. The end of the slot 1301 extends into the opening 1201 of the reinforcing member 1200. In this way, when the electronic card 1500 is inserted into the slot 1301, the reinforcing member 1200 can maintain the shape of the tower portion 1320 from both ends of the electronic card along the longitudinal direction X-X, thereby preventing the tower portion 1320 from deformation or cracking when the electronic card 1500 is impacted by an external force. In addition, since the tower portion 1320 may be higher than the side body 1310 in the vertical direction, the tower portion 1320 with increased strength can be effectively share the impact force applied to the side body 1310. Therefore, the insulating body 1300 is protected from deformation or cracking to a certain extent.

Optionally, the above reinforcing member 1200 may be disposed on only one tower portion 1320. Or, the reinforcing member 1200 may be disposed on each of the two tower portions 1320. Ideally, the reinforcing member 1200 is disposed on each of the two tower portions 1320, and the two reinforcing members 1200 may respectively surround the two ends of the slot 1301.

In some embodiments, as shown in FIG. 6 to FIG. 9, the reinforcing member 1200 may wrap at least a part of the tower portion 1320 from the outer side of the tower portion 1320. In this way, the electrical connector 1100 is convenient to manufacture. In addition, the insulating body 1300 and the reinforcing member 1200 may be separately manufactured and then assembled, thereby further facilitating manufacture and installation. The cost of the electrical connector 1100 is reduced.

In a preferred embodiment, as shown in FIG. 6 to FIG. 11, the reinforcing member 1200 may be embedded in the tower portion 1320. The reinforcing member 1200 does not protrude from the tower portion 1320, and the size of the electrical connector 1100 cannot be increased. In some embodiments, a recess 1330 may be disposed in the outer side surface of the tower portion 1320. The reinforcing member 1200 may be accommodated in the recess 1330. The reinforcing member 1200 can be positioned by the recess 1330, such that the reinforcing member 1200 is located at an expected position. In addition, the structural size of the electrical connector 1100 may also be reduced, and the electrical connector 1100 is more compact.

Figure 8:
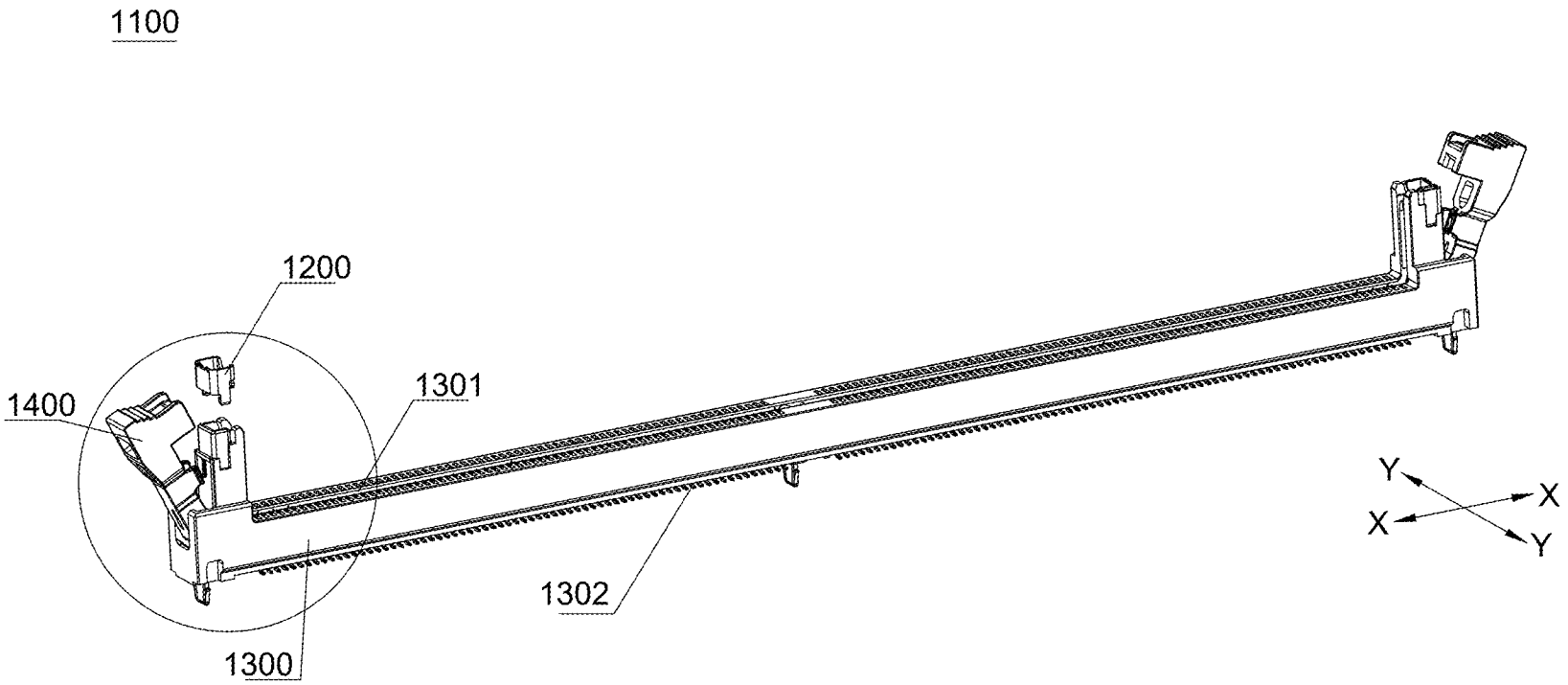
FIG. 8 is an exploded view of an electrical connector shown in FIG. 6.
Figure 9:
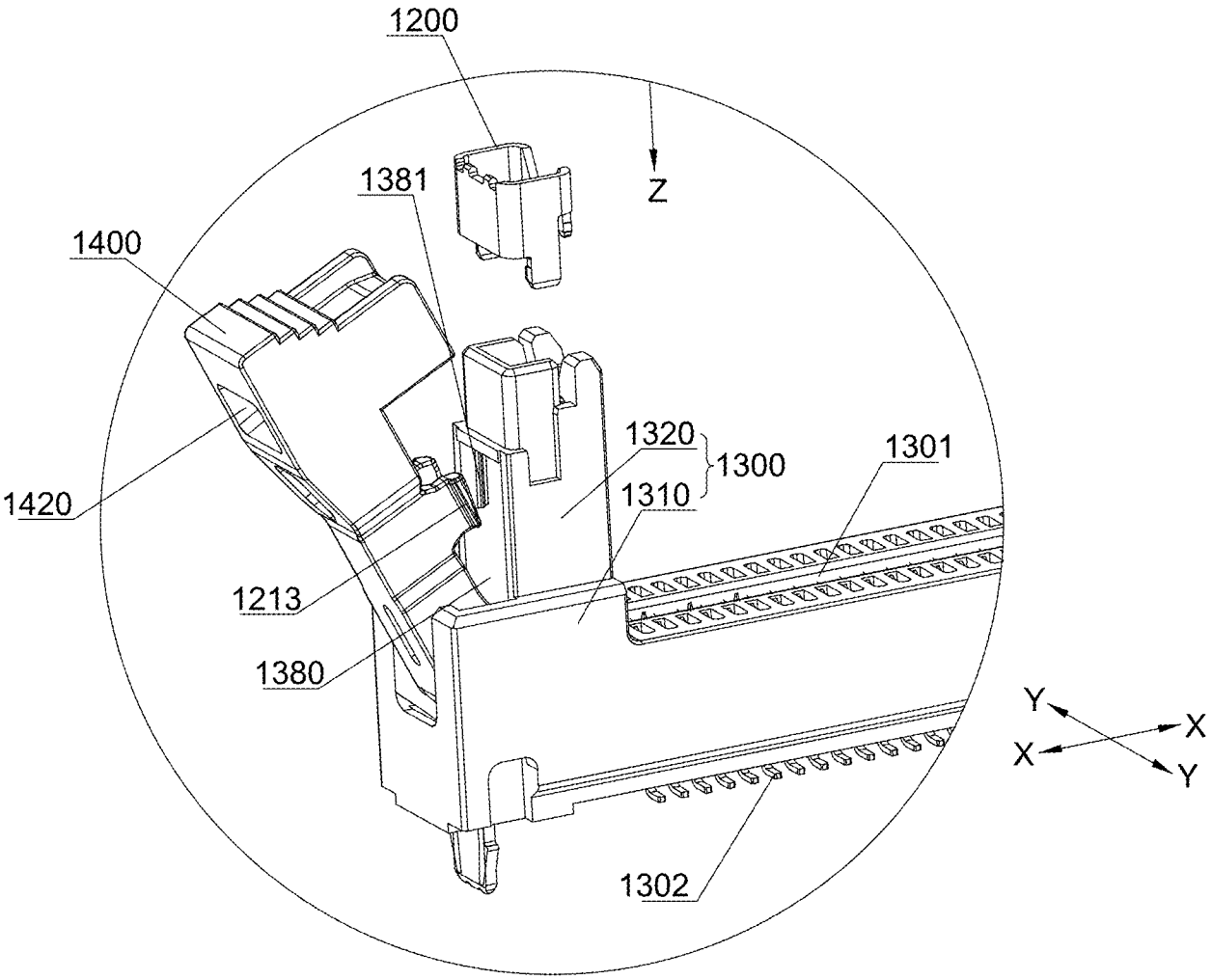
FIG. 9 is a partial enlarged view of the electrical connector shown in FIG. 8.

Further, as shown in FIG. 8 to FIG. 9, the recess 1330 may extend to the top surface of the tower portion 1320. The reinforcing member 1200 may be inserted into the recess 1330 along the vertical direction Z from the top of the tower portion 1320. Since the top surface of the tower portion 1320 is usually located on a side convenient for operation, the reinforcing member 1200 is easier to assemble, and manufacturing cost of the electrical connector 1100 is lower.

Figure 10:
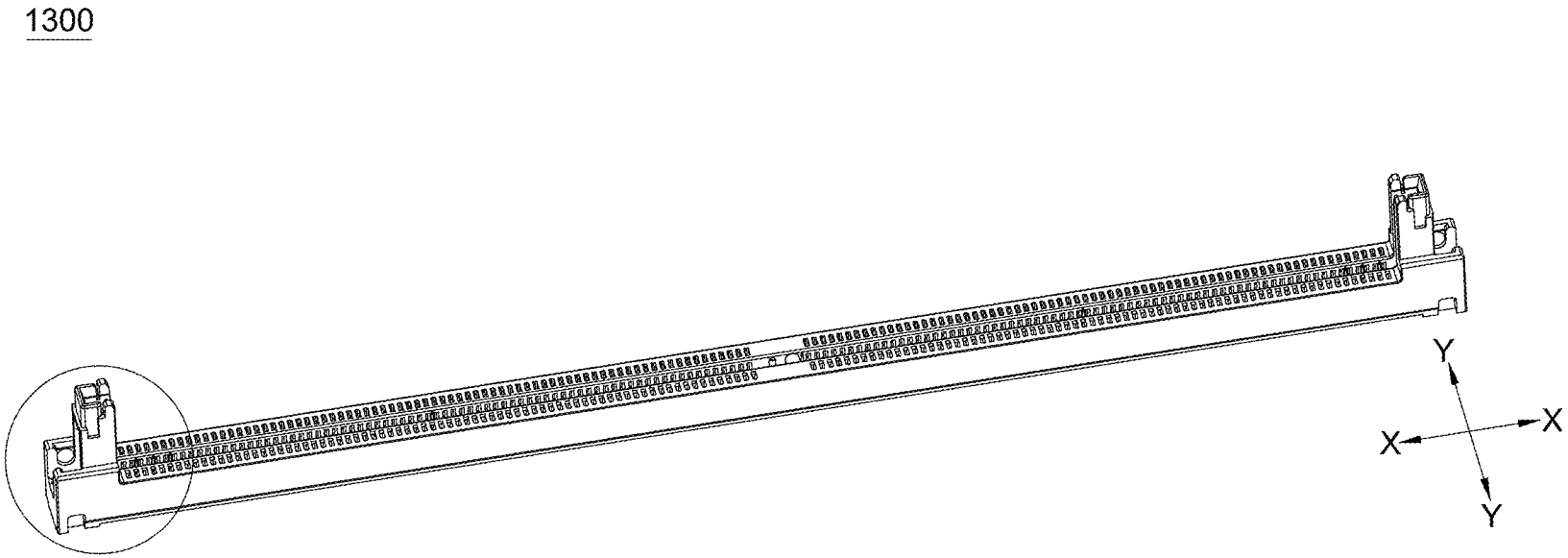
FIG. 10 is a perspective view of an insulating body shown in FIG. 6.
Figure 11:
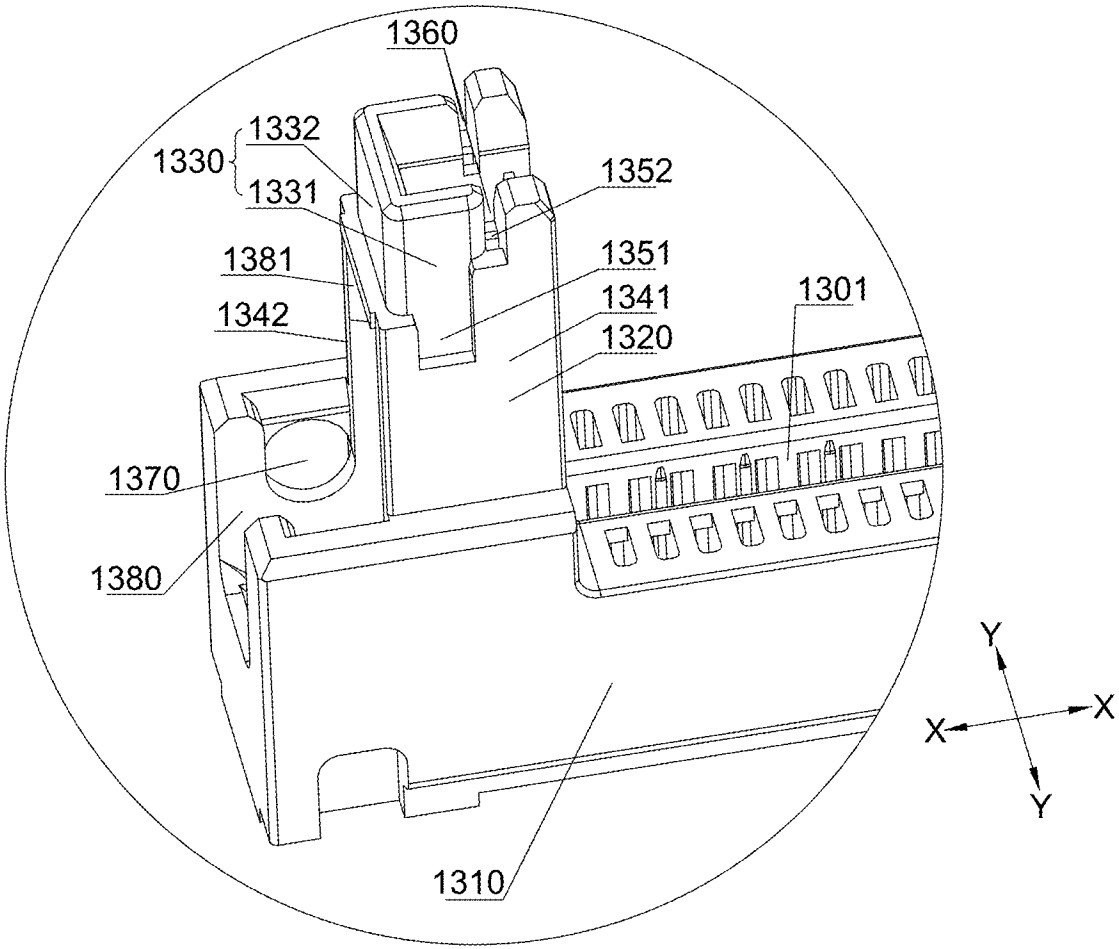
FIG. 11 is a partial enlarged view of the insulating body shown in FIG. 10.

Furthermore, as shown in FIG. 10 to FIG. 11, the tower portion 1320 may include a pair of side walls 1341 and an end wall 1342. The pair of side walls 1341 may extend along the longitudinal direction X-X and are respectively located on both sides of the slot 1301. In some embodiments, a distance between the pair of side walls 1341 may be the same as the transverse width of the slot 1301. The end wall 1342 may be connected to the pair of side walls 1341 by any suitable means, such as welding, bonding, or the like. The end wall 1342 may close the end of the slot 1301. The recess 1330 may include a pair of side recesses 1331 and an end recess 1332. The pair of side recesses 1331 may be respectively located in the pair of side walls 1341. The end recess 1332 may be located in the end wall 1342. The end recess 1332 may be connected between the pair of side recesses 1331. With such an arrangement, the structure of the tower portion 1320 and the recess 1330 therein are simple, which is convenient for molding. In some embodiments, the reinforcing member 1200 may be disposed on the upper part of the tower portion 1320. When the electronic card 1500 connected to the electrical connector 1100 shakes in use, the farther a part of the electronic card 1500 is away from the side body 1310, the greater the shaking is and the greater the impact on the tower portion 1320 is. The reinforcing member 1200 is disposed on the upper part of the tower portion 1320, which is favorable to resist such shaking and improve the impact resistance of the tower portion 1320. Specifically, the reinforcing member 1200 may surround the upper parts of the pair of side walls 1341 and the end wall 1342, and the reinforcing member 1200 may wrap three side surfaces of the tower portion 1320 from the outer side of the tower portion 1320, thereby reinforcing the tower portion 1320 in both the longitudinal direction X-X and the transverse direction Y-Y.

Although each part of the recess 1330 shown in the figures is located on the outer side surface of the tower portion 1320, in other embodiments not shown, the recess 1330 may also be located in the inner surface of the tower portion 1320 or in a wall body of the tower portion 1320 (including the side walls 1341 and the end wall 1342). Optionally, a combination of the above multiple manners may also be used. For example, the recess 1330 may also be partially located in the outer side surface of the tower portion 1320 and partially located within the wall body of the tower portion 1320.

Figure 13:
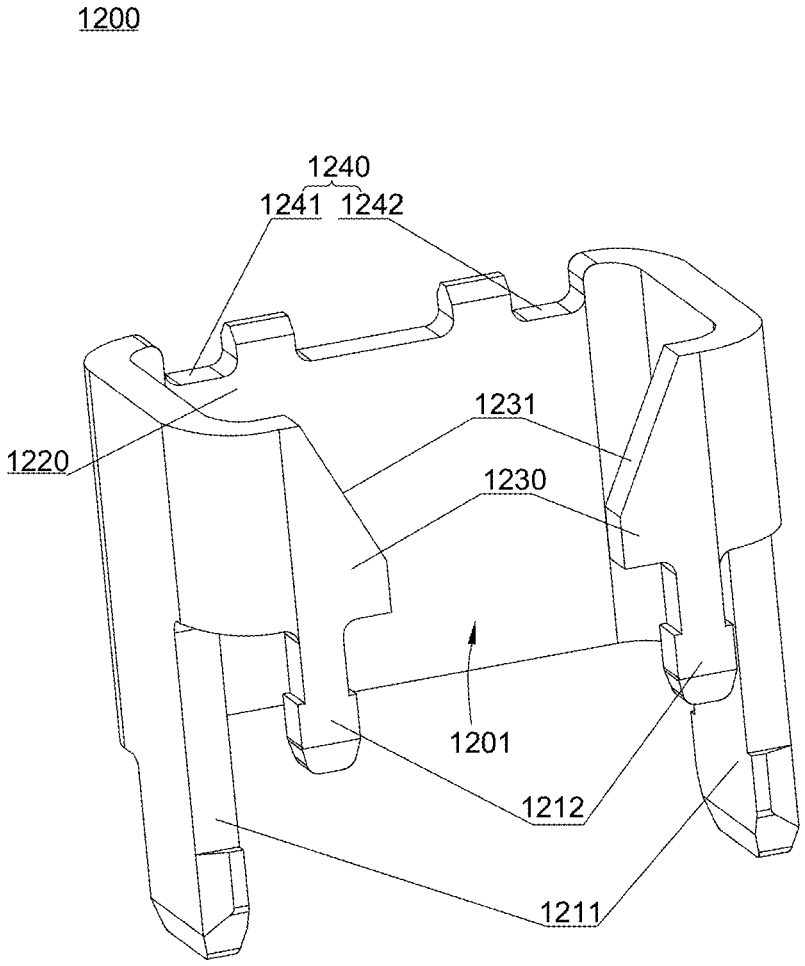
FIG. 13 is a perspective view of a reinforcing member shown in FIG. 6.

Furthermore, as shown in FIG. 10 to FIG. 11, the bottom surface of one or both of the pair of side recesses 1331 may be provided with a first groove 1351 recessed downward. As shown in FIG. 13, the reinforcing member 1200 may include a reinforcing body 1220 and a first protrusion 1211. A cross section of the reinforcing body 1220 may have an U shape. An opening of the U shape may face a tower portion 1320 on the opposite side. That is, w % ben each of the two tower portions 1320 is provided with a reinforcing member 1200, the opening of the U-shaped reinforcing members 1200 face to each other to receive both ends of the electronic card 1500. The first protrusion 1211 may extend downward from the bottom of the reinforcing body 1220. The first protrusion 1211 may be clamped into the first groove 1351. In some embodiments, the first protrusion 1211 may be clamped into the first groove 1351 by interference fit. With such an arrangement, the reinforcing member 1200 can be fixed. Moreover, the size of the reinforcing member 1200 in the vertical direction Z may be longer, so as to protect the tower portion 1320 to a greater extent and avoid deformation or cracking of the insulating body 1300. In addition, the groove for connecting the reinforcing member 1200 is disposed in the side wall 1341 instead of the end wall 1342, which means that the part of the reinforcing member 1200 corresponding to the side wall 1341 may have a larger vertical height, and the part of the reinforcing member 1200 corresponding to the end wall 1342 may have a smaller vertical height. In this way, there is enough space on the end wall 1342 for disposing an engagement hole 1380 described later. The engagement hole 1380 which is relatively larger can facilitate the manufacturing of a third protrusion 1213 on the latch 1400 on one hand, and facilitate air circulation through the engagement hole 1380 which is convenient for heat dissipation on the other hand.

Optionally, as shown in FIG. 10 to FIG. 11, a notch 1360 may be disposed in the top surface of one or both of the pair of side walls 1341. The notch 1360 may be adjacent to and communicated with the side recess 1331 in the side wall 1341 where the notch is located along the longitudinal direction X-X. As shown in FIG. 13, the reinforcing member 1200 may include a reinforcing body 1220 and a hook 1230. The reinforcing body 1220 may be U-shaped to form an opening 1201. The hook 1230 may extend from the edge of the opening 1201 toward the inner of the opening 1201. The hook 1230 may be disposed in the notch 1360. With such an arrangement, it looks like that the reinforcing member 1200 embraces the tower portion 1320, thereby further improving the strength and the impact resistance of the tower portion 1320.

Optionally, as shown in FIG. 10 to FIG. 11, the bottom of the notch 1360 may be provided with a second groove 1352. As shown in FIG. 13, the reinforcing member 1200 may further include a second protrusion 1212 extending downward from the bottom of the hook 1230. The second protrusion 1212 may be clamped into the second groove 1352. In some embodiments, the second protrusion 1212 may be inserted into the second groove 1352 by interference fit. With such an arrangement, the reinforcing member 1200 can be fixed. In addition, the size of the reinforcing member 1200 in the vertical direction Z may be longer, so as to protect the tower portion 1320 to a greater extent and avoid deformation or cracking of the insulating body 1300.

Optionally, as shown in FIG. 13, the top of the hook 1230 may be provided with a chamfer 1231. The chamfer 1231 may play a guiding role. When the electronic card 1500 is inserted into the slot 1301 along the vertical direction Z, the chamfer 1231 can avoid scratching the electronic card 1500 and effectively insert the electronic card 1500 into the slot 1301.

In a preferred embodiment, as shown in FIG. 13, the top of the reinforcing member 1200 may be provided with a hand-held portion 1240. Relevant personnel may insert the reinforcing member 1200 into the recess 1330 from the top of the tower portion 1320 with the aid of the hand-held portion 1240, so that the operation is more comfortable.

Further, as shown in FIG. 13, the hand-held portion 1240 may include a first hand-held groove 1241 and a second hand-held groove 1242. The first hand-held groove 1241 and the second hand-held groove 1242 may be the same or different. The first hand-held groove 1241 and the second hand-held groove 1242 may be disposed at an interval. The first hand-held groove 1241 and the second hand-held groove 1242 may be spaced in any distance. In this way, the relevant personnel can insert the reinforcing member 1200 into the recess 1330 from the top of the tower portion 1320 by putting two fingers into the first hand-held groove 1241 and the second hand-held groove 1242. Therefore, the hand-held portion 1240 with such a structure is compact in structure and easy to manufacture.

In a preferred embodiment, as shown in FIG. 6 to FIG. 9, when the latch 1400 is in a locking position of locking the first printed circuit board, the latch 1400 may extend into the inner of the tower portion 1320 and engage with the tower portion 1320. With such an arrangement, when the latch 1400 is in the locking position, the position of the latch 1400 relative to the insulating body 1300 is fixed. Meanwhile, the structure of the tower portion 1320 may be fully utilized to reduce the transverse width of the part of the latch 1400 at least above the side body 1310 and the transverse width of the tower portion 1320 as much as possible, and the electrical connector 1100 has a better heat dissipation effect.

Further, as shown in FIG. 10 to FIG. 11, an engagement hole 1380 may be disposed in the side surface of the tower portion 1320 facing the latch 1400. When in the locking position, the latch 1400 may extend into the engagement hole 1380 to engage with the engagement hole 1380. By fixing the latch 1400 in such a manner, the strength of the latch 1400 being locked to the insulating body 1300 is higher.

Optionally, the engagement hole 1380 may penetrate the tower portion 1320 along the longitudinal direction X-X, so that not only a space can be provided for engagement of the tower portion 1320 and the engagement hole 1380, but also the material for forming the tower portion 1320 and the manufacturing cost of the electrical connector 1100 are reduced.

In some embodiments, the latch 1400 is provided with a through hole 1420 extending along the longitudinal direction, and the through hole 1420 is communicated with the engagement hole 1380. Viewed along the longitudinal direction X-X, the through hole 1420 may be at least partially overlapped with the engagement hole 1380, so that they are communicated to form an air circulation channel. Optionally, a gap may be disposed between the tower portion 1320 and the latch 1400 along the longitudinal direction X-X, and the gap may be configured to communicate the through hole 1420 with the engagement hole 1380 no matter the through hole 1420 and the engagement hole 1380 are overlapped or not when viewed from the longitudinal direction X-X.

Figure 12:
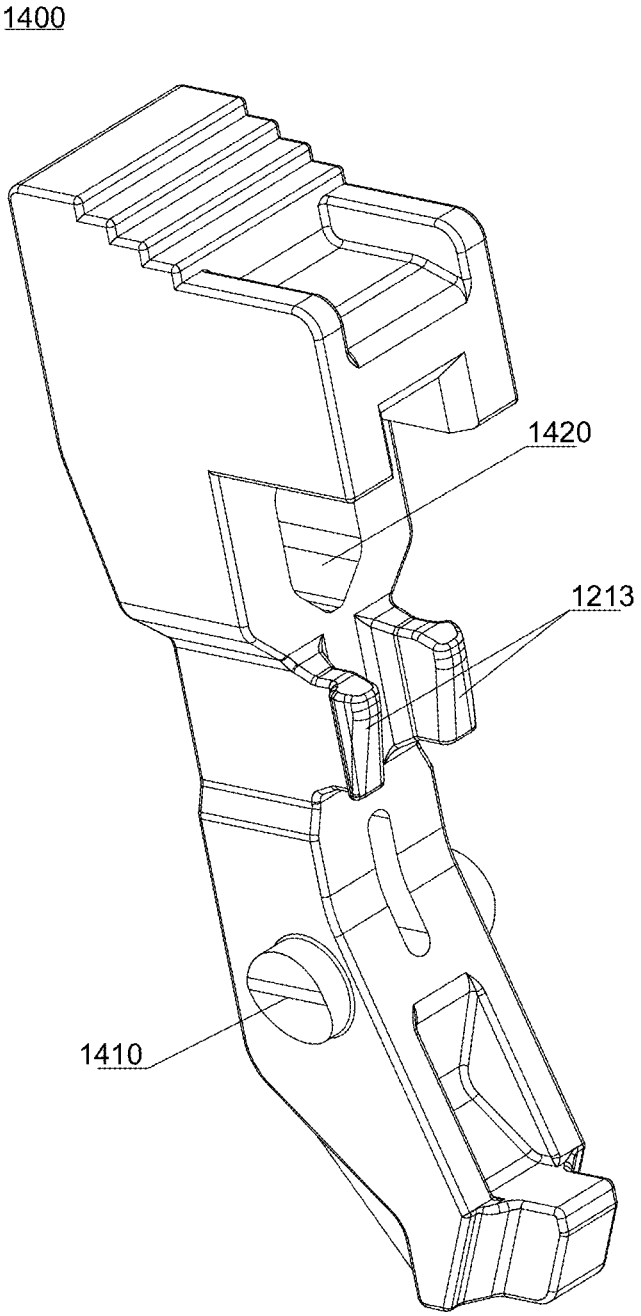
FIG. 12 is a perspective view of the latch shown in FIG. 6.

Optionally, as shown in FIG. 12, a third protrusion 1213 may be disposed on the latch 1400. The number of the third protrusions 1213 may be any. The third protrusion 1213 may extend into the engagement hole 1380 to engage with the engagement hole 1380 when the latch 1400 is in the locking position. Optionally, an engaging portion 1381 for engaging with the third protrusion 1213 may be disposed in the engagement hole 1380. With such an arrangement, the electrical connector 1100 has a simple structure and lower manufacturing cost.

Further, the transverse width of the upper part of the latch 1400 may be greater than the transverse width of the lower part of the latch 1400. The upper part of the latch 1400 may be configured to lock the first printed circuit board. The upper part of the latch 1400 has a relatively large transverse width, which can ensure that the latch 1400 has a sufficient mechanical strength to lock the first printed circuit board. The lower part of the latch 1400 has a relatively small transverse width, so that the lower part of the latch 1400 can be conveniently inserted into the side body 1310 and connected to the side body 1310. The third protrusion 1213 may be disposed on the lower part of the latch 1400. Since the transverse width of the tower portion 1320 is limited, the transverse width of the engagement hole 1380 in the tower portion is also limited. By reducing the transverse width of the lower part of the latch 1400, the third protrusions 1213 can be directly disposed on both sides of the lower part of the latch 1400, thereby facilitating to mold the latch 1400.

Optionally, the transverse width of the upper part of the latch 1400 is equal to the transverse width of the tower portion 1320. Along the transverse direction Y-Y, the center of the latch 1400 is aligned with the center of the tower portion 1320, and the upper part of the latch 1400 covers the tower portion 1320. The transverse width of the lower part of the latch 1400 is slightly less than the transverse width of the tower portion 1320. When the latch 1400 is fastened to the tower portion 1320, the latch 1400 cannot protrude from the tower portion 1320 along the transverse direction Y-Y, thereby not obstructing the air circulation channel between adjacent electronic cards.

Therefore, the present disclosure has been described in way of the above several embodiments. It should be understood that a person skilled in the art can make more variations, modifications and improvements based on the teachings of the present disclosure, and these variations, modifications and improvements shall fall within the spirit and the protection scope of the present disclosure. The protection scope of the present disclosure is defined by the appended claims and their equivalent scopes. The foregoing embodiments are only for the purpose of illustration and description, and are not intended to limit the present disclosure to the scope of the described embodiments.

Various changes may be made to the illustrative structures shown and described herein. For example, the reinforcing member was described in connection with the card edge connector. The reinforcing member may be used in connection with any suitable electrical connectors, such as backplane connectors, daughter card connectors, stacking connectors. Mezzanine connectors, I/O connectors, chip sockets, Gen Z connectors, etc. These connectors have insufficient strength when they suffer from vibration and impact, while the reinforcing member can well enhance the strength of such connectors.

Furthermore, although many inventive aspects are shown and described with reference to a vertical connector, it should be appreciated that aspects of the present disclosure is not limited in this regard. As mentioned, any of the inventive concepts, whether alone or in combination with one or more other inventive concepts, may be used in other types of electrical connectors, such as right angle connectors, coplanar electrical connectors, etc.

In the description of the present disclosure, it needs to be understood that the orientation or positional relationship indicated by the orientation terms such as "front", "rear", "upper", "lower", "left", "right", "transverse", "vertical", "perpendicular". "horizontal", "top", "bottom", etc. is usually based on the orientation shown in the drawings, and is only for the convenience of describing the present disclosure and simplifying the description. These orientation terms do not indicate or imply that the device or element has to have a specific orientation or be constructed and operated in a specific orientation, except as otherwise noted. Therefore, they cannot be understood as a limitation on the scope of the present disclosure. The orientation terms, "inside" and "outside", refer to the inside and outside relative to the contour of each component itself.

For ease of description, spatial terms, such as "above", "on", etc., can be used herein to describe the spatial relationship between one or more components or features shown in the drawings and other components or features. It should be understood that the spatial terms not only include the orientation of the components shown in the drawings, but also include other orientations in use or operation. For example, if the components in the drawings are inverted as a whole, a component "above other components or features" becomes to the component "below other a components or structures". Thus, the exemplary term "above" can include both orientations "above" and "below". In addition, these components or features can also be positioned at other different angles (for example, rotated by 90 degrees or other angles), and this disclosure intends to cover all of these situations.

It should be noted that the terms used herein are only for describing specific implementations, and are not intended to limit to the exemplary implementations according to the present application. As used herein, unless the context clearly indicates otherwise, the singular form is also intended to include the plural form. In addition, the use of "including", "comprising", "having", "containing", or "involving", and variations thereof herein, is meant to encompass the items listed thereafter (or equivalents thereof) and/or as additional items.

It should be noted that the terms "first" and "second" in the description, the claims and the drawings of the application are used to distinguish similar objects, and are not necessarily used to describe a specific sequence. It should be understood that numbers used in this way can be interchanged under appropriate circumstances so that the embodiments of the present disclosure described herein can be implemented in a sequence other than those illustrated or described herein.

What is claimed is:

1. An electrical connector, comprising:

an insulating body comprising a pair of side portions extending in a longitudinal direction, and a pair of tower portions connected to respective ends of the pair of side portions, wherein the pair of side portions and the pair of tower portions form a slot, and the ends of the slot extend into respective ones of the pair of tower portions; and a reinforcing member arranged in one or each of the tower portions, wherein:

a cross section of the reinforcing member is U-shaped, an opening of the U shape faces the slot, and an end portion of the slot extends into the opening of the U-shape;

the one or each of the tower portions comprises an insertion slot holding the reinforcing member;

the reinforcing member comprises a transverse portion extending in a transverse direction perpendicular to the longitudinal direction and an elastic portion bent from a top of the transverse portion in a direction away from the slot; and the elastic portion abuts against the insertion slot of a respective tower portion.

2. The electrical connector according to claim 1, wherein:

the insertion slot comprises a first recess, a second recess, and a third recess between the first recess and second recess; and a depth of the third recess is greater than a depth of the first recess and/or a depth of the second recess.

3. The electrical connector according to claim 1, wherein the insertion slot extends to top surfaces of the tower portions.

4. An electrical connector, comprising:

an insulating body comprising a pair of side portions extending in a longitudinal direction, and a pair of tower portions connected to respective ends of the pair of side portions, wherein the pair of side portions and the pair of tower portions form a longitudinal slot, and the ends of the slot extend into respective ones of the pair of tower portions; and a reinforcing member arranged in one or each of the tower portions, wherein:

a cross section of the reinforcing member is U-shaped, an opening of the U shape faces the slot, and an end portion of the slot extends into the opening of the U-shape;

the one or each of the tower portions comprises an insertion slot holding the reinforcing member;

a first step and a second step are arranged at a bottom of the insertion slot;

the first step and the second step are spaced apart in a transverse direction, such that a first recess and a second recess are formed on two sides of the first step and the second step, respectively;

a third recess is formed between the first step and the second step;

the first recess and the second recess are respectively located on two sides of the slot in the transverse direction; and a lower portion of the reinforcing member is adaptive with the bottom of the insertion slot.

5. The electrical connector according to claim 4, wherein a depth of the third recess is greater than a depth of the first recess and/or a depth of the second recess.

6. The electrical connector according to claim 1, wherein:

the reinforcing member comprises a first longitudinal portion and a second longitudinal portion extending in the longitudinal direction from two ends of the transverse portion respectively; and the first longitudinal portion and the second longitudinal portion are spaced apart to form the opening of the U-shape.

7. The electrical connector according to claim 1, wherein the reinforcing member further comprises a first gripping portion and a second gripping portion protruding upward from the top of the transverse portion; and the first gripping portion and the second gripping portion are respectively located on two sides of the elastic portion in the transverse direction.

8. The electrical connector according to claim 6, wherein the reinforcing member further comprises a first extending portion extending upward from the first longitudinal portion, and a second extending portion extending upward from the second longitudinal portion.

9. The electrical connector according to claim 1, wherein the transverse portion and the first longitudinal portion are connected by a first arc transition portion, and the transverse portion and the second longitudinal portion are connected by a second arc transition portion.

10. The electrical connector according to claim 1, wherein:

the slot comprises a first groove and a pair of second grooves;

the first groove is located between the pair of side portions and extends in the longitudinal direction;

the pair of second grooves are respectively located on side surfaces of the pair of tower portions, and extend in a vertical direction perpendicular to both the longitudinal direction and the transverse direction; and lower ends of the pair of second grooves are respectively connected to two ends of the first groove.

11. An electrical connector, comprising:

an insulating body comprising:

a side body extending in a longitudinal direction, a tower portion protruding upward from an end of the side body, and a slot extending in the longitudinal direction;

a latch connected to an end of the insulating body, wherein the latch is configured to lock a printed circuit board when the printed circuit board is inserted into the slot; and a reinforcing member at least partially wrapping an outer side of the tower portion of the insulating body, wherein a transverse width of a part of the latch at least above the side body is less than a transverse width of the side body, and a transverse width of the tower portion is less than the transverse width of the side body.

12. The electrical connector according to claim 11, wherein the reinforcing member comprises a U-shaped body, and a first protrusion extending from the body in a vertical direction perpendicular to the longitudinal direction.

13. The electrical connector according to claim 11, wherein the reinforcing member wraps at least partially three side surfaces of the tower portion.

14. The electrical connector according to claim 12, wherein the reinforcing member comprises a hook extending from an edge of the body in a transverse direction perpendicular to both the longitudinal direction and the vertical direction, and a second protrusion extending from the hook in the vertical direction.

15. The electrical connector according to claim 11, wherein the outer side of the tower portion comprises a recess extending to the top surface of the tower portion, so that the reinforcing member is inserted into the recess from the top of the tower portion.

16. The electrical connector according to claim 15, wherein: the slot extends from the side body to the tower portion, the tower portion comprises a pair of side walls on both sides of the slot and an end wall at the end of the slot, the recess comprises a pair of side recesses in the pair of side walls respectively and an end recess in the end wall, and the end recess connects the pair of side recesses.

17. The electrical connector according to claim 11, wherein the top of the reinforcing member is provided with a hand-held portion.

18. The electrical connector according to claim 17, wherein the hand-held portion comprises a first hand-held groove and a second hand-held groove which are disposed at an interval.

19. The electrical connector according to claim 11, wherein the reinforcing member is disposed on an upper part of the tower portion.

20. The electrical connector according to claim 11, wherein when the latch is in a locking position configured for locking a printed circuit board, the latch extends to an inner of the tower portion to engage with the tower portion.

* * * * *